US005983062A

United States Patent [19]

Sameshima

[11] Patent Number: 5,983,062

[45] Date of Patent: Nov. 9, 1999

[54] IMAGE FORMING APPARATUS WITH SHIFTING MEANS TO POSITION IMAGE TRANSFER UNIT

[75] Inventor: Takao Sameshima, Mishima, Japan

[73] Assignee: Canon Kabushiki Kaisha, Tokyo, Japan

[21] Appl. No.: 09/060,319

[22] Filed: Apr. 15, 1998

[30] Foreign Application Priority Data

Apr. 18, 1997 [JP] Japan ..... 9-102199
Jul. 10, 1997 [JP] Japan ..... 9-185593

[51] Int. Cl.[6] ..... G03G 15/01

[52] U.S. Cl. ..... 399/302; 399/110; 399/308; 399/316

[58] Field of Search ..... 399/121, 313, 399/316, 317, 302, 308, 110

[56] References Cited

U.S. PATENT DOCUMENTS 5,175,589 12/1992 Kimura ..... 399/121 X
5,371,575 12/1994 Sekino et al. ..... 399/121 X
5,572,305 11/1996 Hayashi et al. ..... 399/121
5,587,769 12/1996 Sawada et al. ..... 399/308 X
5,614,997 3/1997 Marumoto ..... 399/121
5,669,054 9/1997 Uchida et al. ..... 399/313
5,758,247 5/1998 Yanashima et al. ..... 399/384

FOREIGN PATENT DOCUMENTS 8-0216468 8/1996 Japan .
63-149669 6/1998 Japan .

*Primary Examiner*—Susan S. Y. Lee
*Attorney, Agent, or Firm*—Fitzpatrick, Cella, Harper & Scinto

[57] ABSTRACT

An image forming apparatus has a first unit with an image bearing member for bearing an image, a second unit having a transfer device for transferring the image on the image bearing member onto a transfer material, the second unit being rockable around a rock center to engage with and disengage from the first unit and having a positioning portion to be positioned at a predetermined position of the first unit, and a shifter for permitting a shifting movement of the rock center so that the positioning portion is positioned at the predetermined position even when a relative position of the first unit with respect to an apparatus body of the image forming apparatus is changed.

25 Claims, 16 Drawing Sheets

IMAGE FORMING APPARATUS WITH SHIFTING MEANS TO POSITION IMAGE TRANSFER UNIT

BACKGROUND OF THE INVENTION

1. Field of the Invention

The present invention relates to an image forming apparatus such as a copying machine, a laser beam printer and the like, for transferring an image formed on an image bearing means onto a transfer material.

2. Related Background Art

FIGS. 14 and 15 schematically show a conventional color image forming apparatus using an intermediate transfer belt as an intermediate transfer member.

The color image forming apparatus shown in FIGS. 14 and 15 comprises a photosensitive drum (image bearing member) 1, an intermediate transfer unit 5, and a secondary transfer unit 50. The intermediate transfer unit 5 and the unitized photosensitive drum 1 can be mounted to and dismounted from a body of the image forming apparatus along a direction shown by the arrow R1. Further, the intermediate transfer unit 5 can be engaged by and disengaged from the photosensitive drum 1.

The intermediate transfer unit 5 includes triangular intermediate transfer frames 5A disposed in the vicinity of left and right end portions (in the vicinity of both axial ends) of the photosensitive drum 1, a drive roller 5*b* rotatably supported by the intermediate transfer frames 5A, a secondary transfer counter roller 5*c*, a driven roller 5*d*, an endless intermediate transfer belt 5*a* mounted on and wound around these rollers, and a first transfer roller 5*j* for urging the intermediate transfer belt 5*a* against the photosensitive drum 1 from a rear side to form a first transfer nip $N_1$ therebetween.

The secondary transfer unit 50 includes a secondary transfer frame 21 pivotally supported by a rock shaft 22 for rocking movement in a direction shown by the arrow R50, bearings 20 supported at both left and right ends of the secondary transfer frame 21 for vertical movement, a transfer roller 11 having a central shaft 11*a* rotatably supported by the left and right bearings 20, secondary transfer roller pressurizing springs 19 for biasing the respective bearings 20 upwardly, and an eccentric cam (engaging/disengaging means) 18 rotated in a direction shown by the arrow R18 to lift the secondary transfer frame 21 in the direction R50, thereby urging the secondary transfer roller 11 against the intermediate transfer belt 5*a* to form a secondary transfer nip $N_2$ (FIG. 15) therebetween.

In the color image forming apparatus having the above-mentioned construction, in a condition that the secondary transfer unit 50 is retarded to a retard position shown in FIG. 14 and the secondary transfer roller 11 is spaced apart from the intermediate transfer belt 5*a*, the photosensitive drum 1 is rotated in a direction shown by the arrow R1 and the intermediate transfer belt 5*a* is rotated in a direction shown by the arrow R5, so that yellow color, magenta color, cyan color and black color toner images successively formed on the photosensitive drum 1 are first-transferred onto the intermediate transfer belt 5*a* successively in a superimposed fashion by applying first transfer bias to the first transfer roller 5*j* at the first transfer nip $N_1$.

Then, the eccentric cam 18 is rotated in the direction R18 to position the secondary transfer frame 21 to a transfer position shown in FIG. 15, and the secondary transfer roller 11 is urged against the intermediate transfer belt 5*a* to form the secondary transfer nip $N_2$. In synchronous with the intermediate transfer belt 5*a*, a transfer material conveyed by a pair of regist rollers 7*d* is supplied to the secondary transfer nip $N_2$, where the four color toner images on the intermediate transfer belt 5*a* are secondary-transferred onto the transfer material collectively by applying secondary transfer bias to the secondary transfer roller 11.

After the secondary transferring, the transfer material is sent to a fixing device (not shown), where the toner images are fixed to the transfer material with heat and pressure. In this way, the image formation is completed.

In the above-mentioned conventional technique, the positioning of the secondary transfer roller 11 with respect to the intermediate transfer belt 5*a* is achieved by rotating the eccentric cam 18 to urge the secondary transfer roller 11 against the intermediate transfer belt.

Next, an example of an image forming apparatus using an intermediate transfer drum as an intermediate transfer member will be explained with reference to FIGS. 16 and 17.

Four color toner images successively formed on a photosensitive drum 1 rotated in a direction shown by the arrow R1 are successively first-transferred onto an intermediate transfer drum 5B (rotated in a direction shown by the arrow R5) in a superimposed fashion. Then, the four color toner images are collectively secondary-transferred onto a transfer material supplied from a pair of regist rollers 7*d* by means of a secondary transfer unit 50. The secondary transfer unit 50 includes a rockable secondary transfer frame 24A, rollers 11A, 11B, 11D rotatably supported by the secondary transfer frame 24A, a secondary transfer belt 11C mounted and wound around these rollers, a secondary transfer frame pressurizing spring 25A for biasing the secondary transfer frame 24A toward the intermediate transfer drum 5B, and an eccentric cam 18A rotated to lift or lower the secondary transfer frame 24A. The secondary transfer frame 24A can be rocked around a shaft of the roller 11B. Upon the secondary-transferring of the toner images onto the transfer material, when the eccentric cam 18A is rotated by about a half revolution from a position shown in FIG. 16 to a position shown in FIG. 17, a tip end (right end in FIG. 16) of the secondary transfer frame 24A is lifted, with the result that the roller 11A is urged against the intermediate transfer drum 5B to form a secondary transfer nip $N_2$ between the intermediate transfer drum SB and the secondary transfer belt 1C. While the transfer material is being passed through the secondary transfer nip $N_2$, the toner images on the intermediate transfer drum 5B are transferred onto the transfer material collectively by applying secondary transfer bias to the roller 11A.

The above-mentioned conventional technique (FIGS. 14 and 15) in which the intermediate transfer belt 5*a* is used as the intermediate transfer member, the positioning of the secondary transfer roller 11 with respect to the intermediate transfer belt 5*a* is achieved by rotating the eccentric cam 18 to urge the secondary transfer roller 11 against the intermediate transfer belt.

Thus, the positional accuracy of the secondary transfer roller 11 with respect to the intermediate transfer unit 5 depends upon attachment accuracy from a rock shaft 22 of the secondary transfer frame 21 to the secondary transfer roller 11 and dimensional accuracy of the eccentric cam 18, with the result that it is difficult to keep the correct positional accuracy regarding the up-and-down direction and the left-and-right direction in FIGS. 14 and 15. Further, regarding the secondary transfer roller 11, it is difficult to maintain the parallelism of the intermediate transfer unit 5 with respect to the secondary transfer counter roller 5*c*. It is particularly noticeable in an apparatus in which the intermediate transfer unit 5 and the photosensitive drum 1 can detachably mounted on the apparatus body and an apparatus in which the intermediate transfer member can be engaged by and disengaged from the photosensitive drum 1.

Thus, the urging force of the secondary transfer roller 11 against the intermediate transfer belt 5*a* becomes unstable to generate unevenness in the urging forces at the left and right ends of the secondary transfer roller 11, poor image due to fluctuation of pressure during the secondary-transferring and/or skew-feed of the transfer material. Further, the penetration of the transfer material into the secondary transfer nip $N_2$ becomes unstable to generate incorrect positioning of an image tip and/or sheet jam.

Incidentally, such problems occur in the conventional technique (FIGS. 16 and 17) in which the intermediate transfer drum 5B is used as the intermediate transfer member. Further, such problems occur similarly in mono-color image forming apparatuses in which a toner image on a photosensitive drum is transferred onto a transfer material at a transfer nip between the photosensitive drum and a transfer roller.

SUMMARY OF THE INVENTION

An object of the present invention is to provide an image forming apparatus in which a second unit can be positioned with respect to a first unit with high accuracy.

DETAILED DESCRIPTION OF THE PREFERRED EMBODIMENTS

The present invention will now be explained in connection with embodiments thereof with reference to the accompanying drawings.

<First Embodiment>

Figure 1:
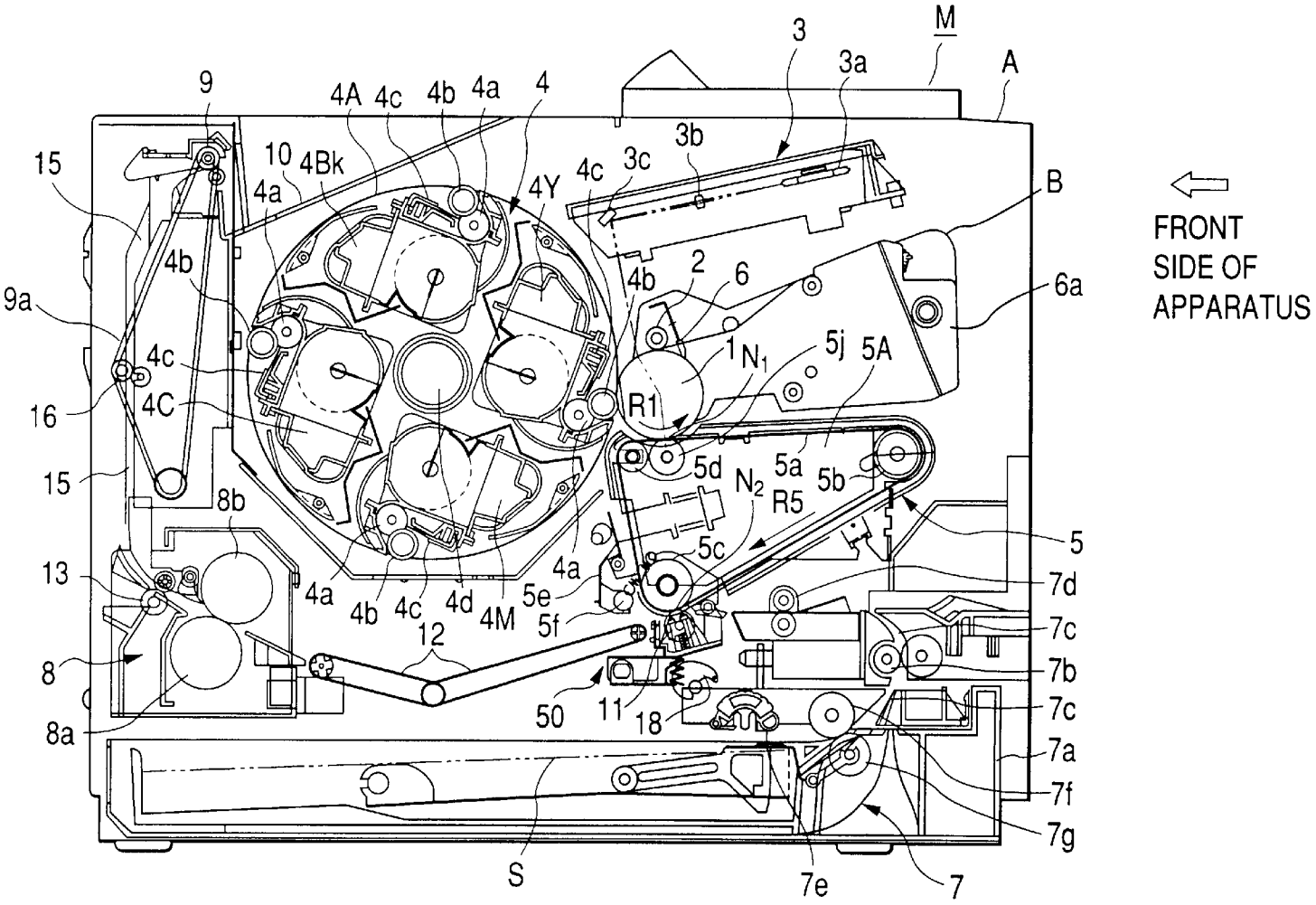
FIG. 1 is a schematic elevational sectional view of an image forming apparatus according to a first embodiment of the present invention.

FIG. 1 is an elevational sectional view showing an example of a color image forming apparatus according to the present invention. The color image forming apparatus shown in FIG. 1 is embodied as a four full-color laser beam printer of electrophotographic type (referred to merely as "image forming apparatus" hereinafter).

First of all, the entire construction of the image forming apparatus M will be described briefly with reference to FIG. 1.

The image forming apparatus M shown in FIG. 1 includes a drum-type electrophotographic photosensitive member 1 as an image bearing member (referred to as "photosensitive drum" hereinafter). The photosensitive drum 1 is rotated in a direction shown by the arrow R1 by means of a drive means (not shown). Around the photosensitive drum 1, in order along a rotational direction thereof, there are disposed a charge device 2 for uniforming charging a surface of the photosensitive drum 1, an exposure means 3 for forming an electrostatic latent image on the photosensitive drum 1 by illuminating a laser beam corresponding to image information to remove charges from the photosensitive drum 1, a developing means 4 for developing the electrostatic latent image with toner as a toner image, an intermediate transfer unit 5 having an intermediate transfer belt (intermediate transfer member) 5*a* onto which the toner image on the photosensitive drum 1 is first-transferred, and a cleaning device 6 for removing first-transferring residual toner remaining on the photosensitive drum 1 after the first-transferring. Incidentally, the photosensitive drum 1, charge device 2 and cleaning device 6 are integrally incorporated into a cartridge unit to form a process cartridge B which can detachably be mounted on an apparatus body A of the image forming apparatus M.

Next, a mounting/dismounting mechanism for the process cartridge B will be described.

Figure 11:
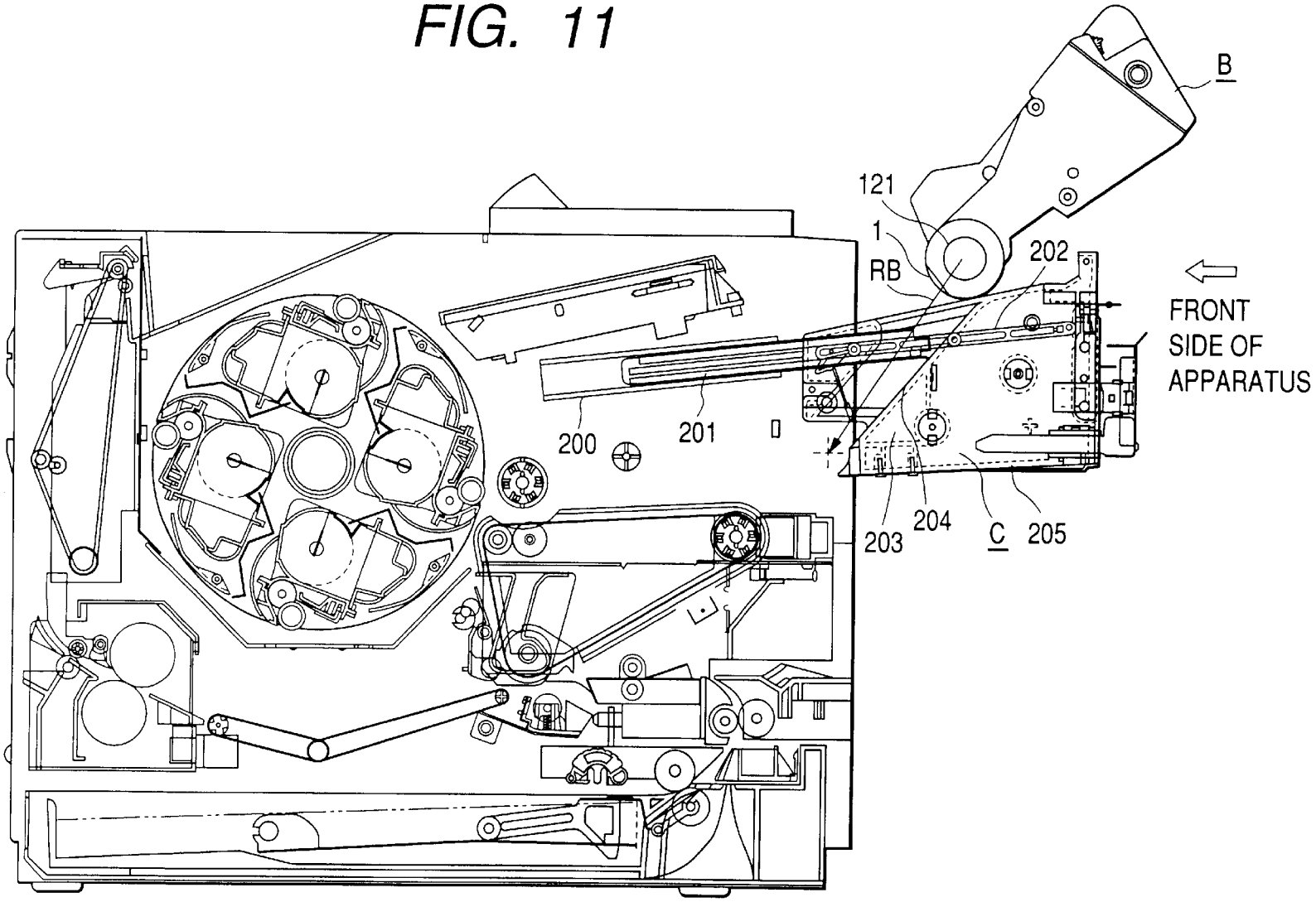
FIG. 11 is a view showing a condition that a cartridge B is dismounted from an apparatus body.

FIG. 11 shows a condition that the process cartridge B (referred to merely as "cartridge B" hereinafter) is drawn out of the apparatus body together with a drawer-type movable member C.

In FIG. 11, the drawer-type movable member C is designed so that first slide rails 201 are slid on guide rails 200 secured to both side walls of the apparatus body A and second slide rails 202 are slid within the first slide rails. With this arrangement, a shift (drawn) distance through which the drawer-type movable member C is fully drawn out of the apparatus body while mounting the cartridge B thereon is lengthened. Stoppers 201*a*, 202*b* are provided so that the first and second slide rails can be stopped at predetermined positions. The drawer-type movable member C has a bottom plate 205, and side plates 203, 206 disposed at both sides of the bottom plate. There is provided guide grooves 204 for insertion and withdrawal of the cartridge B. The cartridge B can be mounted on and dismounted from the drawer-type movable member C by shifting holding members 121 coaxial with the photosensitive drum 1 and having a drive transmitting portion therein along the guide grooves 204 of the drawer-type movable member C (in a direction RB).

The image forming apparatus M further includes a supply/convey means 7 for supplying and conveying a transfer material (recording medium) S toward the intermediate transfer unit 5, a secondary transfer unit 50 for secondary-transferring the toner images on the intermediate transfer belt 5*a* onto the transfer material S collectively, and a fixing device 8 for fixing the toner images to the transfer material S after the secondary-transferring.

Next, the photosensitive drum 1, charge device 2, exposure means 3, developing means 4, and intermediate transfer unit 5 will be fully described in order.

The photosensitive drum 1 is constituted by an aluminium cylinder having a diameter of 47 mm (for example), and a sensitive layer (photoconductive layer) made of OPC (organic photo semi-conductor) and coated on the aluminium cylinder. The photosensitive drum 1 is rotatably supported by the apparatus body A at its both ends and is rotated in the direction R1 by transmitting a driving force from a drive motor (not shown) to one end of the photosensitive drum.

As the charge device 2, for example, a charger of so-called contact charging type disclosed in Japanese Patent Laid-Open Application No. 63-149669 (1988) can be used. As a charge member, a conductive charge roller is used. The surface of the photosensitive drum 1 is uniformly charged by contacting the charge roller with the surface of the photosensitive drum 1 and by applying charge bias voltage to the charge roller from a power source (not shown).

The exposure means 3 has a polygon mirror 3*a* onto which light corresponding to an image signal is illuminated from a laser diode (not shown). The polygon mirror 3*a* is rotated at a high speed by a scanner motor (not shown), so that reflected image light selectively exposes the surface of the photosensitive drum 1 (already charged by the charge device 2) through a focusing lens 3*b* and a reflection mirror 3*c*, thereby forming the electrostatic latent image.

The developing means 4 includes a rotary member 4A rotated around a shaft 4*d* in an index manner, and four developing devices 4Y, 4M, 4C, 4Bk mounted on the rotary member and containing yellow toner, magenta toner, cyan toner and black toner, respectively. When the electrostatic latent image on the photosensitive drum 1 is developed, a selected developing device containing the color toner to be adhered to the electrostatic latent image is brought to a developing station where the selected developing device is opposed to the photosensitive drum 1. That is to say, the selected developing device is brought to the developing station by the index movement of the rotary member 4A, and, after a developing sleeve 4*b* of the selected developing device is positioned to be opposed to the photosensitive drum 1 with a small gap (about 300 $\mu$m) therebetween, the electrostatic latent image on the photosensitive drum 1 is developed. Incidentally, in FIG. 1, the yellow developing device 4*y* is positioned at the developing station.

The development is effected as follows. The toner in a container of the developing device corresponding to the color to be developed is sent to a coating roller 4*a* by a toner feed mechanism, and a thin toner layer is formed on the rotating developing sleeve 4*b* by the rotating coating roller 4*a* and a toner regulating blade 4*c*, and charges are applied to the toner (friction charging). By applying developing bias between the developing sleeve 4*b* and the photosensitive drum 1 on which the electrostatic latent image was formed, the toner is adhered to the electrostatic latent image to form the toner image. When the developing device selected from the developing devices 4Y, 4M, 4C and 4Bk is positioned at the developing station, the developing sleeve 4*b* of the selected developing device is connected to a corresponding high voltage source of the apparatus body A so that the voltage can selectively be applied to the developing sleeve. The developing devices 4Y, 4M, 4C and 4Bk can be mounted on and dismounted from the rotary member 4A independently.

Figure 2:
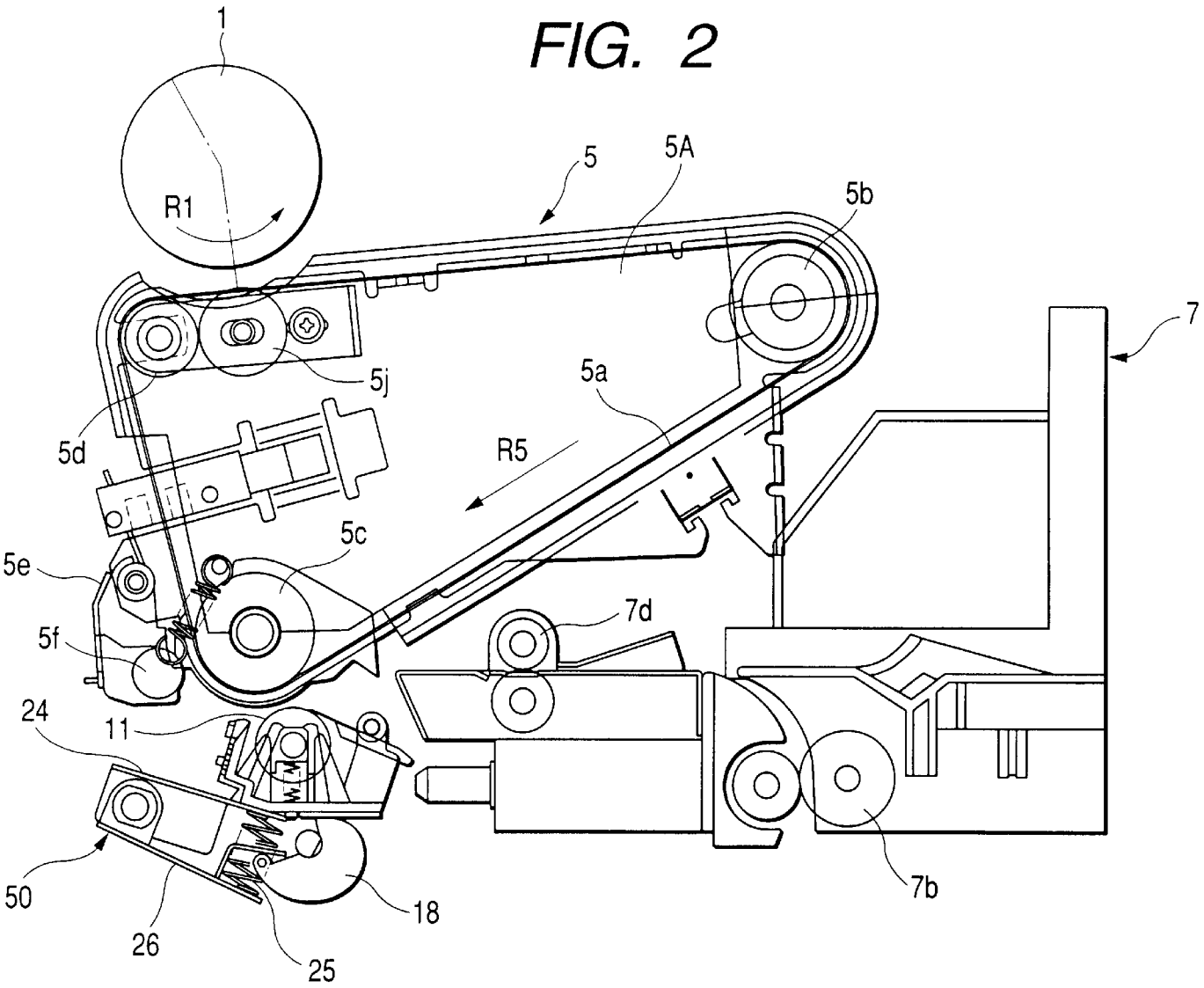
FIG. 2 is a view showing an intermediate transfer unit and a secondary transfer unit of the image forming apparatus according to the first embodiment before image formation.
Figure 3:
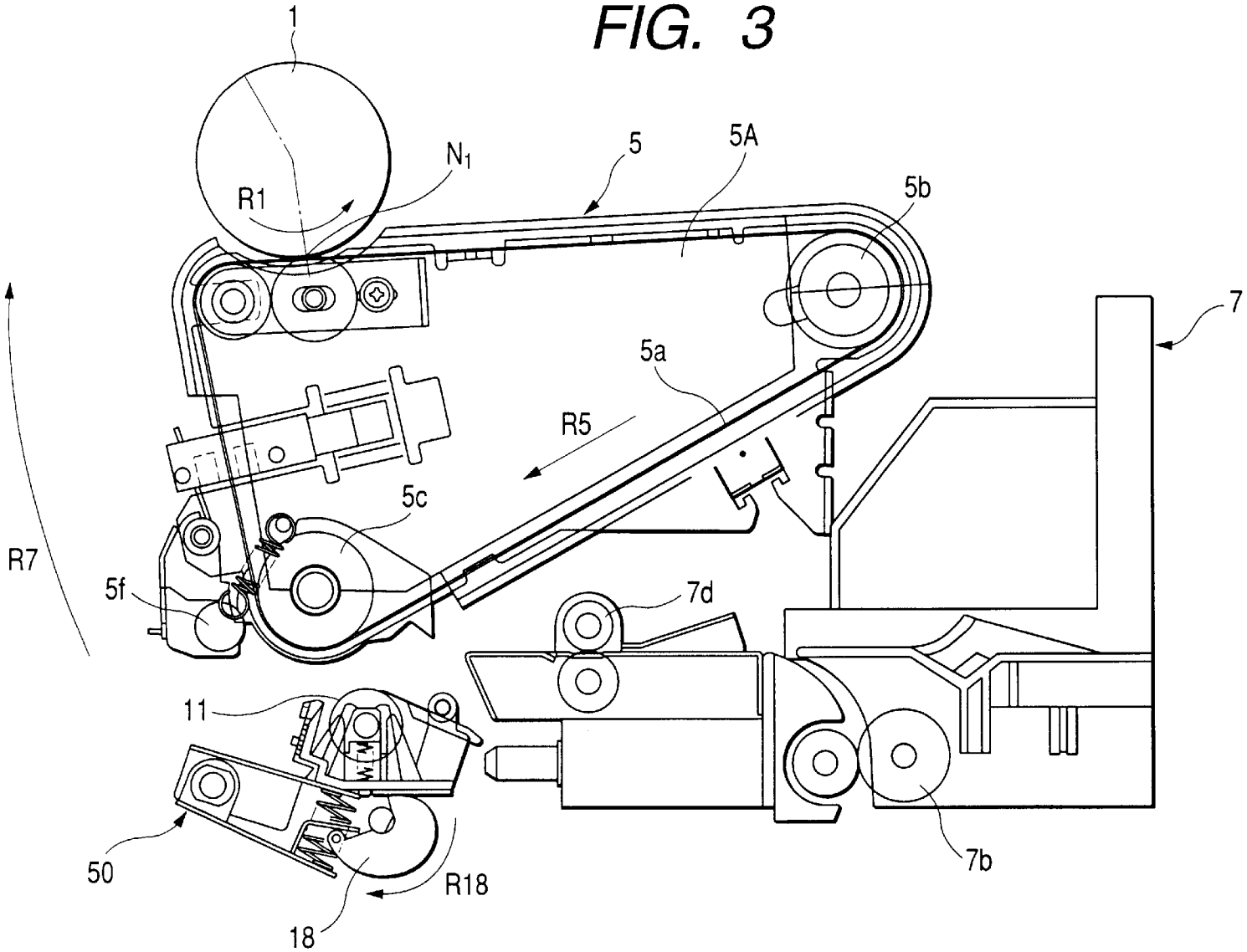
FIG. 3 is a view showing the intermediate transfer unit and the secondary transfer unit of the image forming apparatus according to the first embodiment during first-transferring.

The intermediate transfer unit 5 serves to secondary-transfer the superimposed four color toner images (from the photosensitive drum 1) onto the transfer material S collectively. The intermediate transfer unit 5 includes the intermediate transfer belt 5*a* (as the intermediate transfer member) shifted (rotated) in the direction R5. In the first embodiment, the intermediate transfer belt 5*a* is an endless belt having a peripheral length of about 440 mm and mounted and wound around a drive roller 5*b*, a secondary transfer counter roller 5*c* and a driven roller 5*d*. Further, a first transfer roller 5*j* with which a rear surface of the intermediate transfer belt 5*a* is contacted is disposed in the vicinity of the driven roller 5*d*. The drive roller 5*b*, secondary transfer counter roller 5*c*, driven roller 5*d* and first transfer roller 5*j* are supported, at their both ends, by frames (first transfer frames) 5A disposed on both sides of a shifting direction of the intermediate transfer belt 5*a* and the frames 5A are supported for pivotal movement around the drive roller 5*b*. With this arrangement, the intermediate transfer belt 5*a* can be rocked between a retard position (as shown in FIG. 2) where the belt is spaced apart from the surface of the photosensitive drum 1 and a transfer position (position shifted in a direction R7, as shown in FIG. 3) where the belt is contacted with the surface of the photosensitive drum 1. In the transfer position, the intermediate transfer belt 5*a* is pinched between the photosensitive drum 1 (from a front surface side) and the first transfer roller 5*j* (from a rear surface side) to form the first transfer nip $N_1$ between the surface of the photosensitive drum 1 and the intermediate transfer belt 5*a*. Further, the intermediate transfer unit 5 can be mounted on and dismounted from the apparatus body.

Next, a mounting/dismounting mechanism for the intermediate transfer unit 5 with respect to the apparatus body A will be explained.

Figure 12:
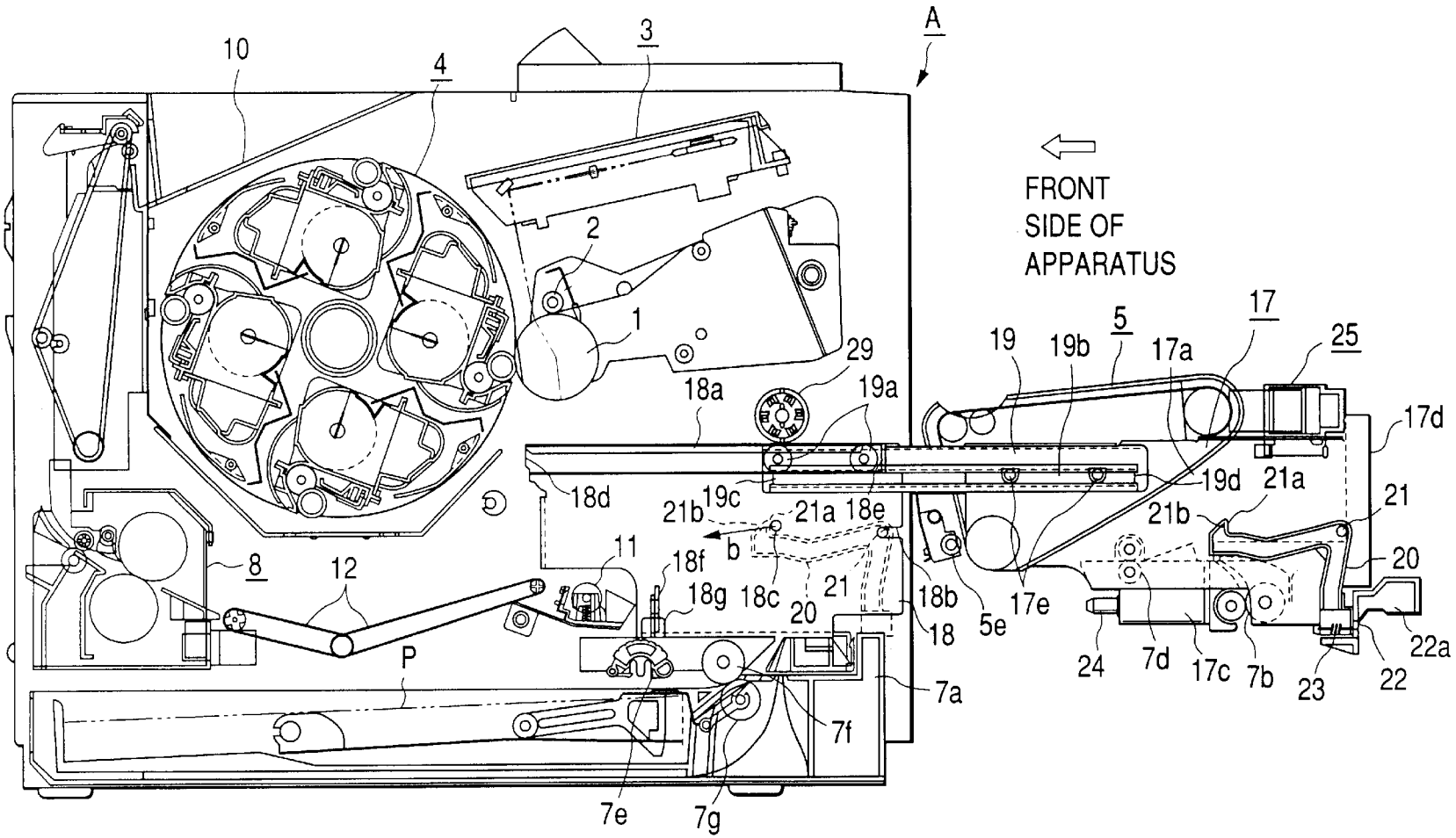
FIG. 12 is a view showing a condition that the intermediate transfer unit is drawn from the apparatus body.

FIG. 12 is a schematic sectional view showing a condition that the intermediate transfer unit 5 is drawn from the apparatus body A.

A drawer unit 17 on which the intermediate transfer unit 5 is mounted and which is drawn from the apparatus body A toward a front side is fundamentally constituted by a left drawer side plate 17*a*, a right drawer side plate 17*b* (FIG. 13), a lower drawer frame 17*c*, and a front drawer frame 17*d*.

Two guide pins 17*e* are formed on the left drawer side plate 17*a* and are inserted into a groove 19*b* of a secondary rail 19 and can be slid within the groove. Further, two sub-rollers 19*a* disposed at an end portion of the second rail 19 can be fitted into a guide portion of a first rail 18*a* formed on a rail stay 18 of the apparatus body A.

The right drawer side plate 17*b* has a construction similar to the left drawer side plate 17*a* and includes two sub-rollers 19*a* fitted into the guide portion of the first rail 18*a* formed on the rail stay 18 of the apparatus body A.

With the arrangement as mentioned above, by shifting the drawer unit 17 from a stopper 18*d* to a stopper 18*e* disposed at both ends of the first rail 18*a* and further shifting the unit from a stopper 19*c* to a stopper 19*d* disposed at both ends of the second rail 19, the intermediate transfer unit 5 is fully drawn out of the apparatus body A horizontally toward the front side. The drawer unit 17 is drawn from a contained condition shown in FIG. 1 by about 300 mm.

The drawer unit 17 further includes lock levers 20 disposed outside of the left and right drawer side plates 17*a*, 17*b*, and the left and right lock levers 20 are interconnected via a connection plate 22 having a grip 22*a*. The left and right lock levers 20 can be rotated around coaxial positioning pins 21 and are biased by a tension spring 23. Further, left and right positioning pins 24 are formed on the lower drawer frame 17*c*.

Further, a cleaning unit 5*e*, a pair of convey rollers 7*b* and a pair of regist rollers 7*d* are attached to the drawer unit 17 so that these elements can be drawn together with the drawer unit 17. Incidentally, in FIG. 2, the reference numeral 25 denotes an intermediate transfer member urging slide unit; and 29 denotes an intermediate transfer member positioning member.

When the drawer unit 17 drawn from the apparatus body A at the front side is returned into the apparatus body A, as the drawer unit 17 is pushed into the apparatus body A, the positioning pins 24 are fitted into positioning holes 18*f* formed in the rail stay 18 and the positioning pins 21 are fitted into positioning grooves 18*b* of the rail stay 18.

In this case, first tapered surfaces 21*b* of the lock levers 20 ride over lock pins 18*c* formed on the rail stay 18 to receive the lock pins 18*c* into second tapered surfaces 21*a*, with the result that, under the action of the tension spring 23, a reaction force for urging the drawer unit 17 toward a direction b from the second tapered surfaces 21*a* is generated. Thus, the drawer unit 17 is urged against a positioning stopper 18*g* of the rail stay 18 and is positioned there.

When the drawer unit 17 is drawn out, by pulling the grip 22*a* toward the front side of the apparatus body A, the engagement between the lock pins 18*c* and the second tapered surfaces 21*a* of the lock levers 20 is released, thereby permitting the withdrawal of the drawer unit 17 as shown in FIG. 2.

Next, a mounting/dismounting operation of the intermediate transfer unit 5 with respect to the drawer unit 17 will be explained.

Figure 13:
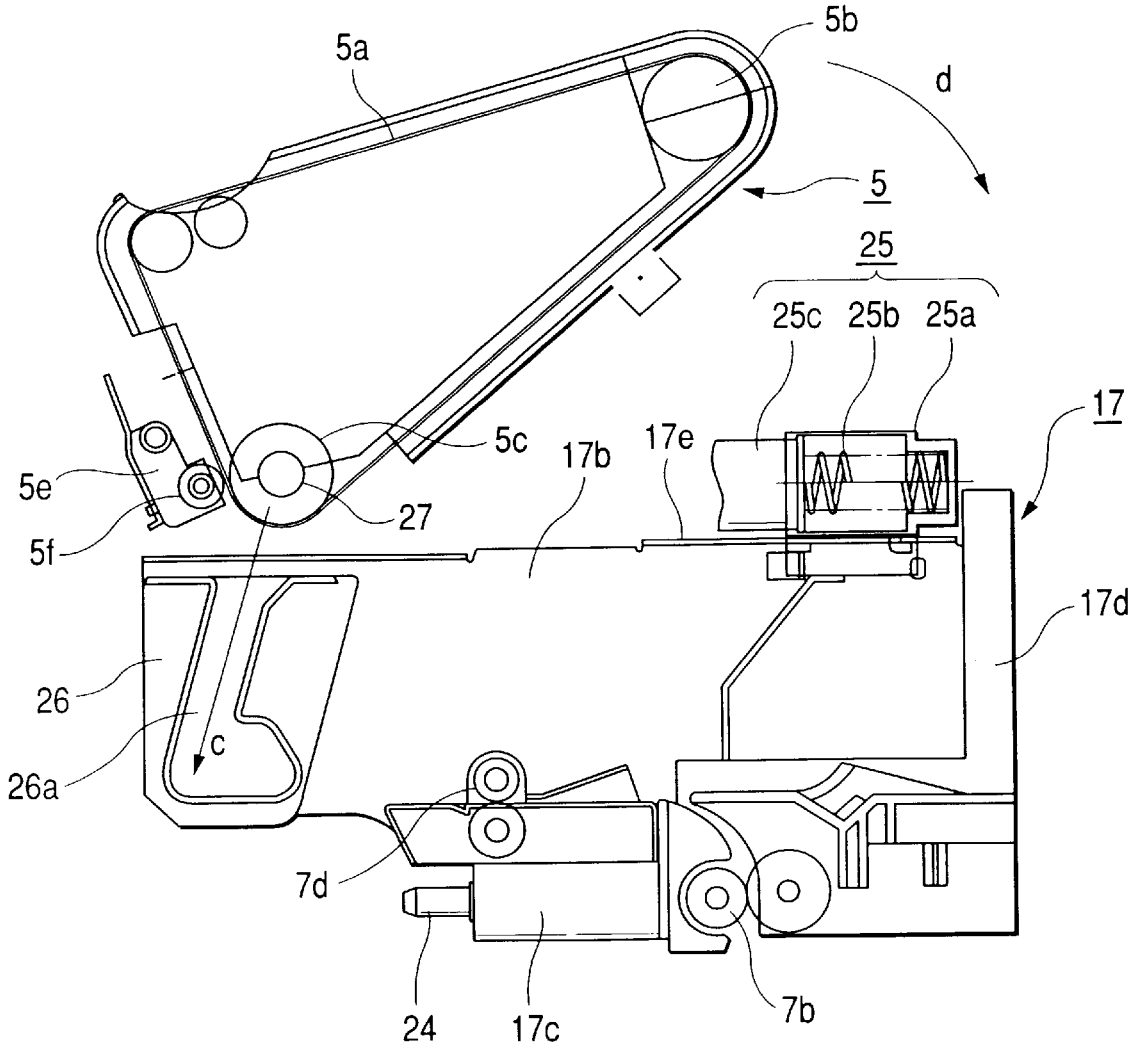
FIG. 13 is a view showing a condition that the intermediate transfer unit is mounted on a drawer unit.
Figure 14:
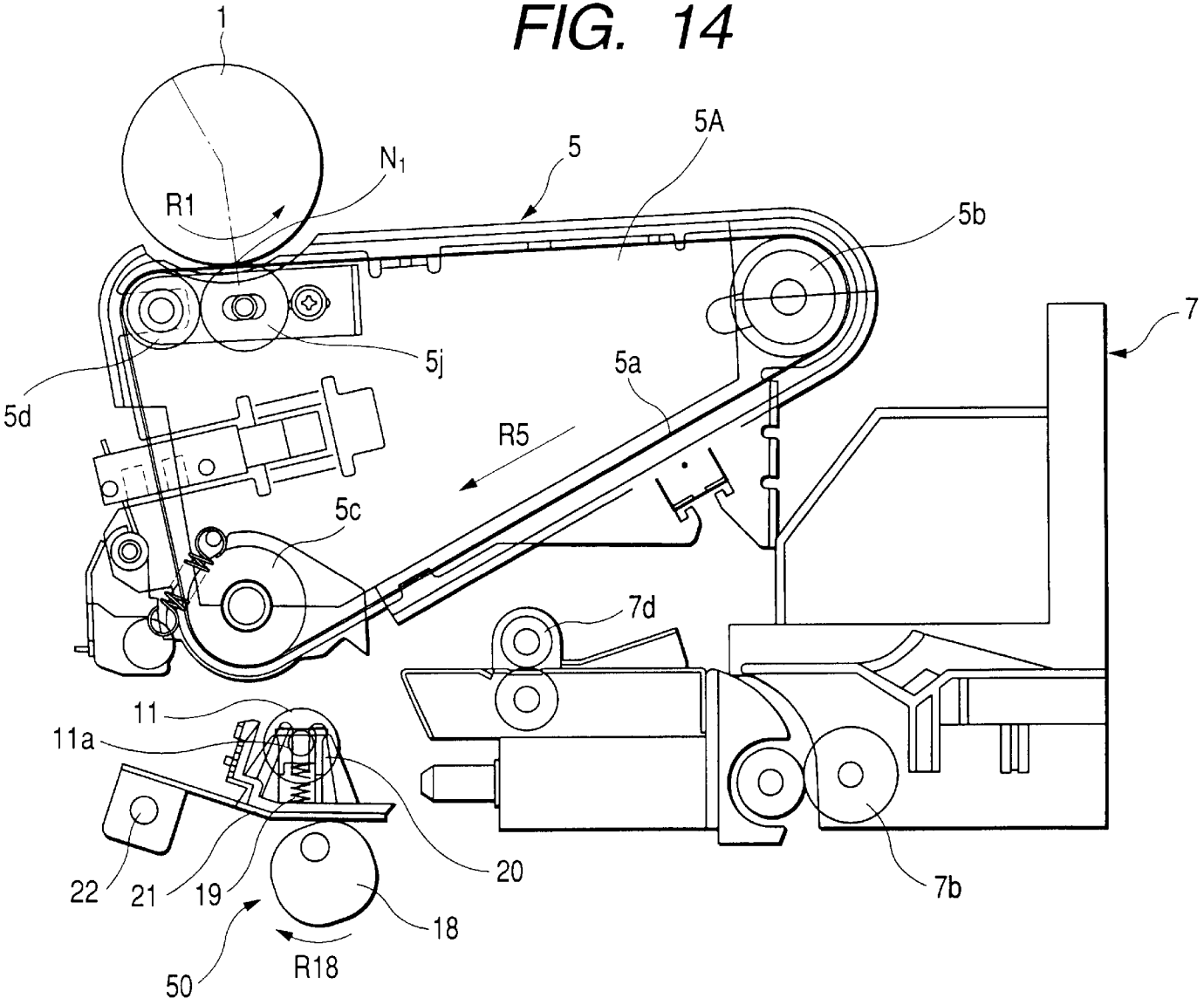
FIG. 14 is a view showing an intermediate transfer unit and a secondary transfer unit of a conventional color image forming apparatus using an intermediate transfer belt, during first-transferring.
Figure 15:
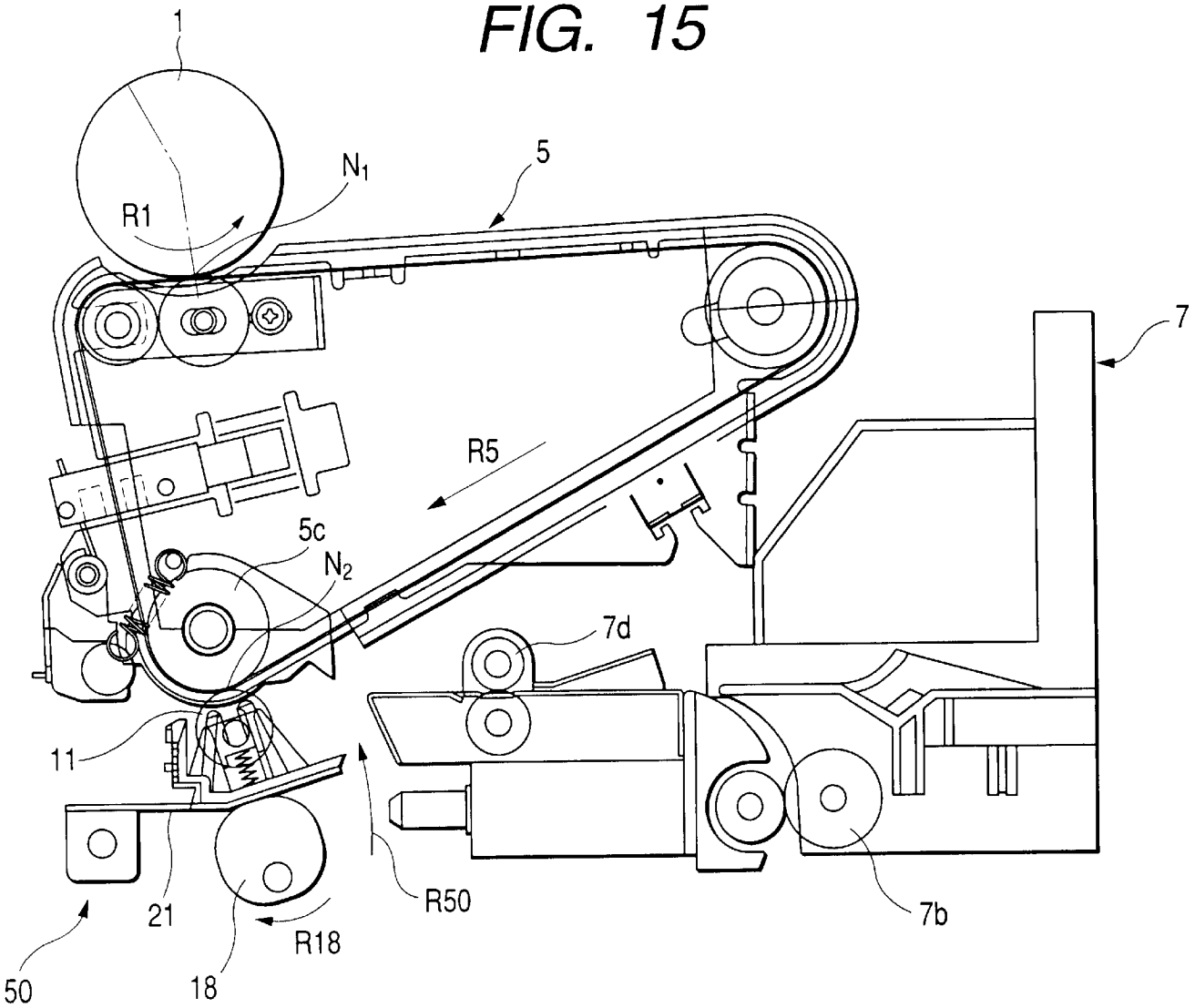
FIG. 15 is a view showing the intermediate transfer unit and the secondary transfer unit of the conventional color image forming apparatus using the intermediate transfer belt, during secondary-transferring.
Figure 16:
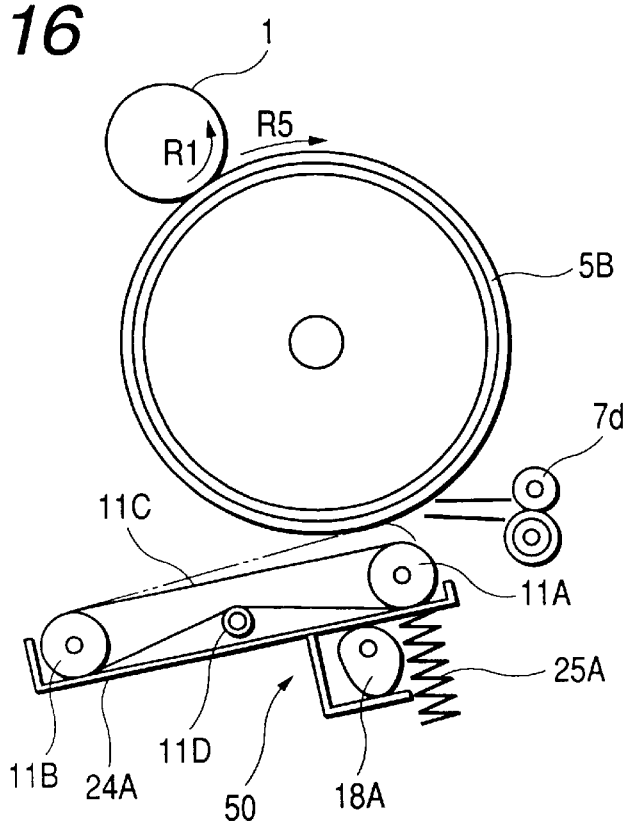
FIG. 16 is a view showing an intermediate transfer unit and a secondary transfer unit of a conventional color image forming apparatus using an intermediate transfer drum, during first-transferring.
Figure 17:
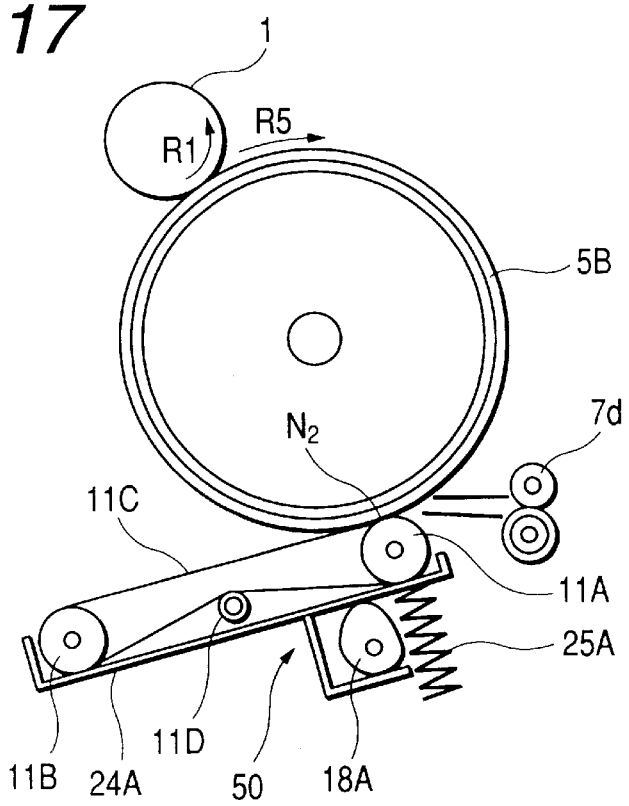
FIG. 17 is a view showing the intermediate transfer unit and the secondary transfer unit of the conventional color image forming apparatus using the intermediate transfer drum, during secondary-transferring.

FIG. 13 is a schematic sectional view showing a condition before the intermediate transfer unit 5 is mounted on the drawer unit 17 drawn from the apparatus body A at the front side.

As shown in FIG. 13, the left and right drawer side plates 17*a*, 17*b* of the drawer unit 17 are provided with a guide plate 26 and the intermediate transfer member urging slide unit 25, respectively. In a condition that the drawer unit 17 is drawn from the apparatus body A, when the intermediate transfer member is mounted on the drawer unit, left and right guide shafts 27 coaxial with the secondary transfer counter roller 5*c* of the intermediate transfer unit 5 are inserted toward a direction c along guide grooves 26*a* of the guide plates 26.

When the guide shafts 27 reach bottoms 26*b* of the guide grooves 26*a*, the intermediate transfer unit 5 is rotated around the guide shafts 27 in the direction d to ride the bearings of both ends of the drive roller 5*b* on seat portions 17*e* of the left and right drawer side plates 17*a*, 17*b*, thereby mounting the intermediate transfer unit 5 on the drawer unit 17.

Each intermediate transfer member urging slide unit 25 is constituted by an urging member 25*c*, a compression spring 25*b* and an urging member guide portion 25*a*. The urging members 25*c* lightly urge the bearings of both ends of the drive roller 5*b* of the intermediate transfer unit 5 to the left in FIG. 13. Further, when the intermediate transfer unit 5 is removed from the intermediate transfer member urging slide units 25, a reverse operation may be effected.

The intermediate transfer belt 5*a* is rotated in the direction R5 by rotation of the drive roller 5*b*. The cleaning unit 5*e* which can be engaged by and disengaged from the surface of the intermediate transfer belt 5*a* is disposed at a predetermined position outside of the intermediate transfer belt 5*a* to remove secondary-transferring residual toner (described later). The cleaning unit 5*e* serves to apply charges having polarity opposite to that in the transferring to the secondary-transferring residual toner by abutting the transfer roller 5*f* against the intermediate transfer belt 5*a*. The oppositely charged secondary-transferring residual toner is electrostatically re-transferred onto and adhered to the photosensitive drum at the first transfer nip $N_1$, and, thereafter, is collected by the cleaning device 6 for the photosensitive drum 1. Incidentally, a method for cleaning the intermediate transfer belt 5*a* is not limited to the above-mentioned electrostatic cleaning, but, a mechanical method using a blade or a fur brush, or a combination of the electrostatic cleaning and the mechanical cleaning may be used.

The cleaning device 6 serves to remove first-transferring residual toner remaining on the surface of the photosensitive drum 1 after the toner images developed on the photosensitive drum 1 was first-transferred onto the intermediate transfer belt 5*a* and the secondary-transferring residual toner re-transferred to the photosensitive drum. In the illustrated cleaning device 6, the first-transferring residual toner and the secondary-transferring residual toner are collected and stored in a cleaning container 6*a*.

The supply/convey means 7 serves to supply the transfer material S to the image forming portion and includes a sheet supply cassette 7*a* containing a plurality of transfer materials S and detachably mounted on the apparatus body A. In the image formation, a pick-up roller (semi-circular roller) 7*e*, a feed roller 7*f* and a retard roller 7*g* are rotated in response to the image forming operation, with the result that the transfer materials S contained in the sheet supply cassette 7*a* are separated and supplied one by one and the separated transfer material is conveyed by the pair of convey rollers 7*b* along a guide plate 7*c*. A tip end is temporarily stopped by the pair of regist rollers 7*d* to form a loop in the transfer material. Thereafter, in synchronous with the rotation of the intermediate transfer belt 5*a* and an image record start position, the transfer material is supplied, by the pair of regist rollers 7*d*, to the secondary transfer nip $N_2$ formed between the intermediate transfer unit 5 and the secondary transfer unit 50.

The secondary transfer unit 50 includes the eccentric cam (engaging/disengaging means) 18. By the rotation of the eccentric cam, the secondary transfer roller 11 can be rocked between a transfer position (FIGS. 1, 4 and 6) where the secondary transfer roller is contacted with the intermediate transfer belt 5*a* and a retard position (FIGS. 3 and 5) where the secondary transfer roller is spaced apart from the intermediate transfer belt 5*a*. When the secondary transfer roller 11 is brought to the transfer position, the intermediate transfer belt 5*a* is pinched between the secondary transfer roller 11 and the secondary transfer counter roller 5*c* to form the secondary transfer nip $N_2$ between the intermediate transfer belt 5*a* and the secondary transfer roller 11. Incidentally, the secondary transfer unit 50 will be further fully described later.

The fixing device 8 serves to fix the secondary-transferred four color toner images to the transfer material S and includes a rotating heat roller 8*b*, and a pressure roller 8*a* urged against the heat roller and adapted to apply heat and pressure to the transfer material S. That is to say, the transfer material S passed through the secondary transfer roller 11 for collectively transferring the toner images on the intermediate transfer belt 5*a* is conveyed on a convey belt unit 12. While the transfer material is being passed through the fixing device 8, the transfer material is conveyed by the heat roller 8*b* and the pressure roller 8*a* and is heated and pressurized by these rollers 8*b*, 8*a*. In this way, the four toner images are fixed to the surface of the transfer material S.

Next, the image forming operation of the image forming apparatus M will be explained.

The photosensitive drum 1 is rotated in the direction R1 in FIG. 1 in synchronous with the rotation of the intermediate transfer belt 5*a*, the surface of the photosensitive drum 1 is uniformly charged by the charge device 2, and the yellow image light is illuminated by the exposure means 3, thereby forming the electrostatic latent image corresponding to the yellow color on the photosensitive drum 1. In synchronous with the formation of the electrostatic latent image, the developing means 4 is driven to bring the yellow developing device 4Y to the developing station. By applying the voltage having substantially the same charging polarity and potential as those of the photosensitive drum 1 to adhere the yellow toner to the electrostatic latent image on the photosensitive drum 1, the yellow toner is adhered to the electrostatic latent image to develop the latter. Thereafter, the intermediate transfer belt 5*a* is brought to the transfer position. By applying the voltage having polarity opposite to that of the toner to the first transfer roller 5*j*, the yellow toner image on the photosensitive drum 1 is electrostatically first-transferred onto the intermediate transfer belt 5*a*.

When the first-transferring of the yellow toner image is finished in this way, the next developing device is rotated to be brought to the developing station, where the next developing device is opposed to the photosensitive drum 1. Similar to the yellow color, regarding the magenta, cyan and black colors, the formation of the electrostatic latent image, development and first-transferring are effected. In this way, the four color toner images are successively first-transferred onto the intermediate transfer belt 5*a* in a superimposed fashion.

Meanwhile, as shown in FIG. 3, the secondary transfer roller 11 is spaced apart from the intermediate transfer belt 5*a*. In this case, the charge roller 5*f* of the cleaning unit 5*e* is also apart from the intermediate transfer belt 5*a*.

After the four color toner images were first-transferred onto the intermediate transfer belt 5*a* in the superimposed fashion, the secondary transfer roller 11 is urged against the intermediate transfer belt 5*a* (FIGS. 1, 4 and 6), and, in synchronous with the rotation of the intermediate transfer belt 5*a* in the direction R5, the transfer material S waited by the pair of regist rollers 7*d* is supplied to the secondary transfer nip $N_2$ between the intermediate transfer belt 5*a* and the secondary transfer roller 11.

Then, by applying the voltage having the polarity opposite to that of the toner to the secondary transfer roller 11, the superimposed four color toner images on the intermediate transfer belt 5*a* are electrostatically secondary-transferred onto the transfer material S collectively.

The transfer material S to which the four color toner images were secondary-transferred in this way is sent, by the convey belt unit 12, to the fixing device 8, where the toner images are fixed to the transfer material. Thereafter, the transfer material is conveyed along a sheet discharge guide 15 by pairs of sheet discharge rollers 13, 16 and then is discharged by a pair of discharge rollers 9 onto a sheet discharge tray 10 formed on the apparatus body A. The reference numeral 9*a* denotes a drive belt for transmitting a driving force to the pair of sheet discharge rollers 16 and the pair of discharge rollers 9.

Next, the intermediate transfer unit 5 and the secondary transfer unit 50 which are characteristics of the present invention will be further fully described. Incidentally, as will be described later, the secondary transfer unit 50 can be rocked around the rock shaft 22.

Figure 4:
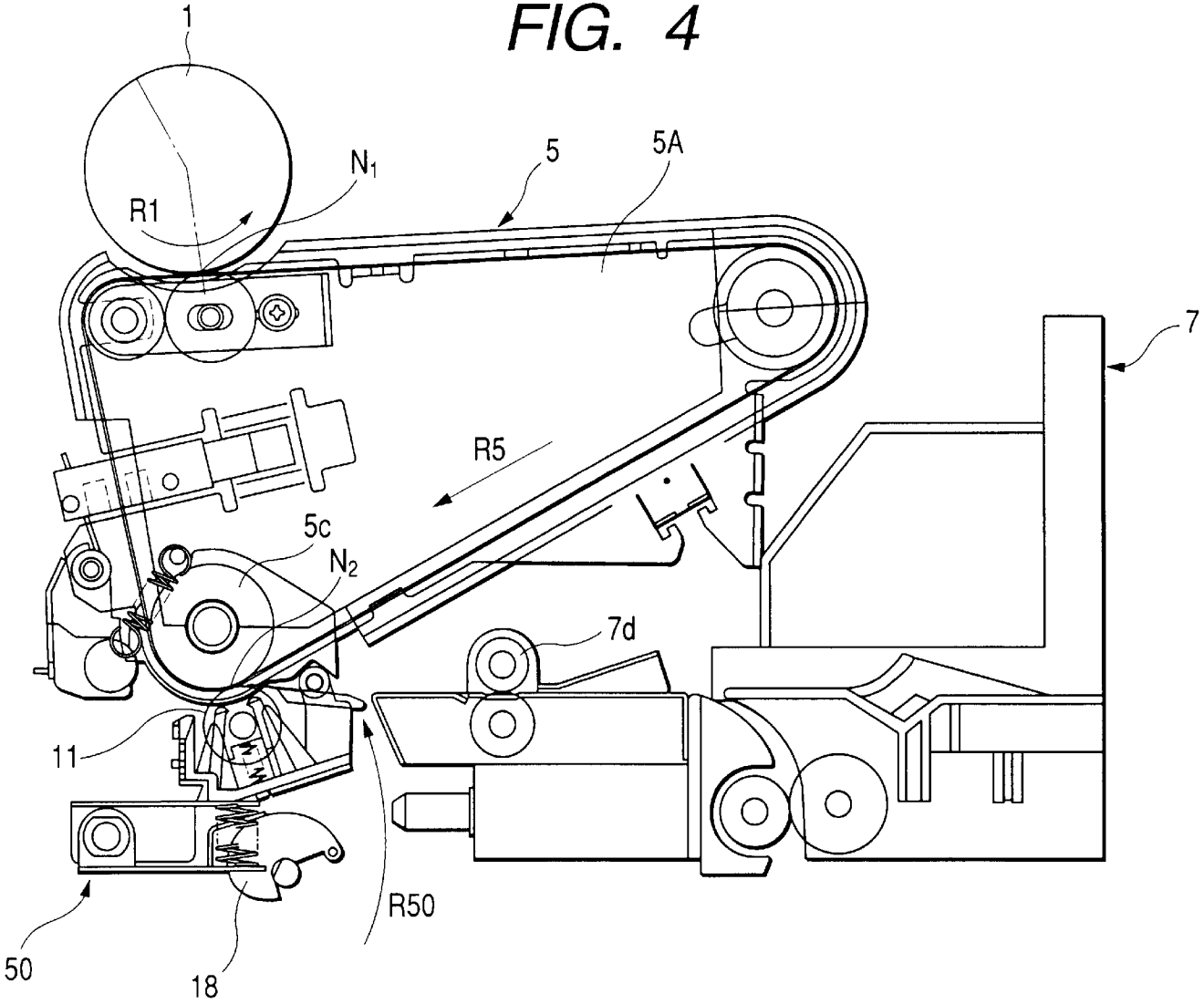
FIG. 4 is a view showing the intermediate transfer unit and the secondary transfer unit of the image forming apparatus according to the first embodiment during secondary-transferring.
Figure 5:
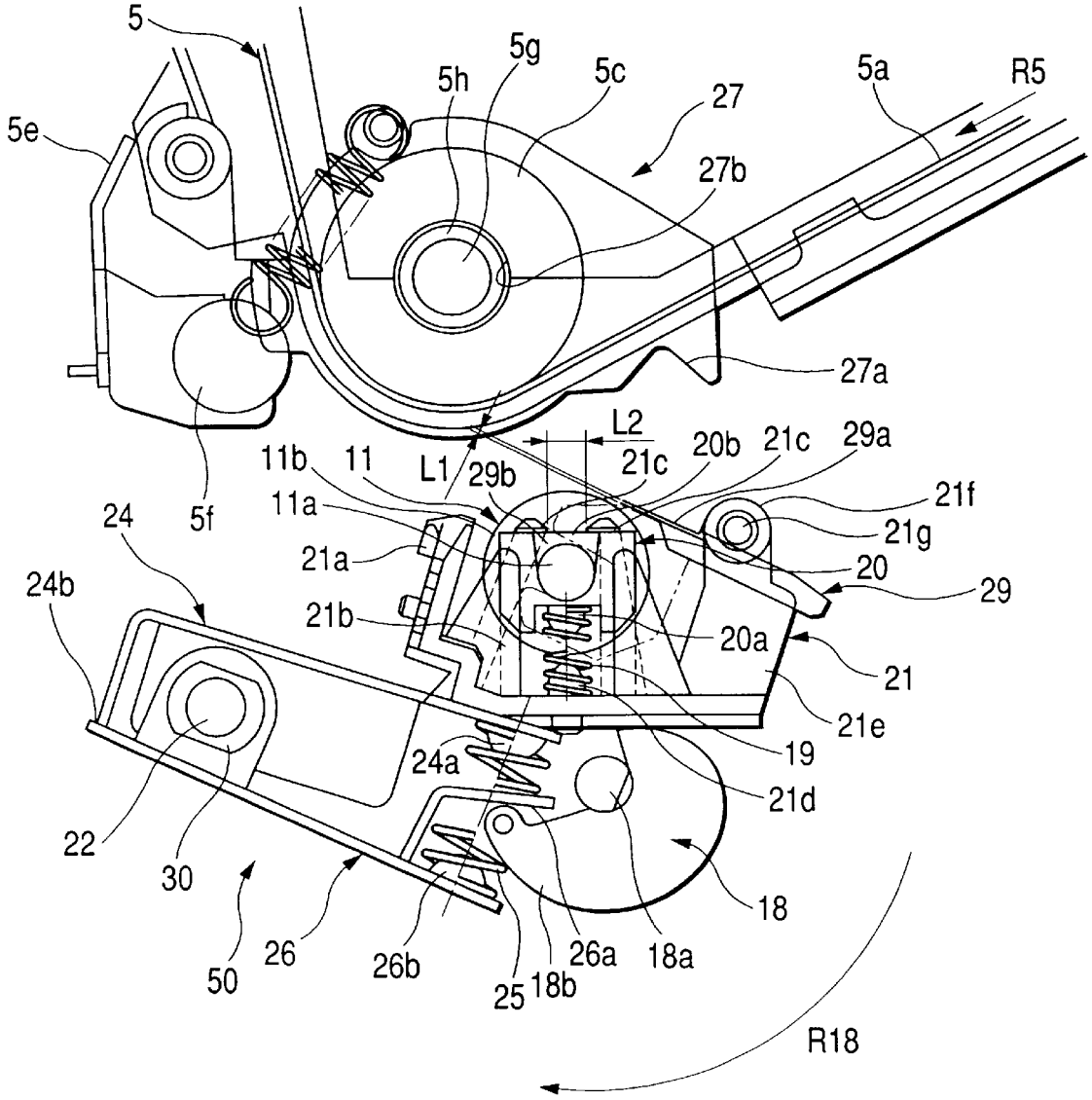
FIG. 5 is an enlarged view of the secondary transfer unit in FIG. 3.

FIG. 3 is a sectional view showing a condition that the secondary transfer unit 50 is located at the retard position (i.e., spaced apart from the intermediate transfer belt 5*a*), and FIG. 4 is a sectional view showing a condition that the secondary transfer unit 50 is located at the transfer position (i.e., urged against the intermediate transfer belt 5*a*). FIG. 5 is an enlarged view of the secondary transfer unit 50 in FIG. 3, and FIG. 6 is an enlarged view of the secondary transfer unit 50 in FIG. 4.

In FIG. 5, the secondary transfer frame 21 is formed from cast material and is secured to a secondary transfer base plate 24 made of sheet metal, and the secondary transfer frame 21 and the secondary transfer base plate 24 have lengths greater than a width (in the left-and-right direction) of the intermediate transfer belt 5*a* in the left-and-right direction (left-and-right direction regarding a supplying direction of the transfer material, i.e., vertical direction with respect to the plane of FIG. 5). Coaxial shafts 21*g* directing toward the left-and-right direction are formed on left and right ends of the secondary transfer frame 21, and cylindrical positioning abutment portions (abutment members) 21*f* are rotatably supported by the left and right shafts 21*g*. The secondary transfer roller 11 has an elastic portion (sponge portion) 11*b* and a metallic core shaft 11*a* passing through a center of the elastic portion, and left and right ends of the core shaft 11*a* are rotatably supported by the respective bearings 20. Each bearing 20 has an U-shaped receiving portion 20*b* with an open top and is supported by a slide guide 21*b* (extending upwardly from the secondary transfer frame 21) for substantially vertical movement. Each bearing 20 has a boss portion 20*a* extending downwardly therefrom, and a secondary transfer roller pressurizing spring (compression spring) 19 is disposed between the boss portion 20*a* and a boss portion 21*d* opposed to the boss portion 20*a* and extending upwardly from the secondary transfer frame 21. Each bearing 20 is biased upwardly by the secondary transfer roller pressurizing spring 19, and an upper limit position of each bearing is regulated to a position shown in FIG. 5 by stoppers 21*c*. The stoppers 21*c* prevent the core shaft 11*a* of the secondary transfer roller 11 from detaching from the bearings 20. That is to say, the two stoppers 21*c* are formed from elastic members, and a distance L2 between tip ends of the stoppers is selected to become slightly smaller than a diameter of the core shaft 11*a*. With this arrangement, in the normal operation, the core shaft 11*a* of the secondary transfer roller 11 is prevented from detaching from the U-shaped receiving portions 20*b* of the bearings 20, and, the core shaft 11*a* can easily be mounted to the bearing 20 in a snap fit manner. An electricity removing needle cover portion 21*a* capable of mounting an electricity removing needle (not shown) for removing the charges from the transfer material S after the secondary-transferring is provided on the secondary transfer frame 21 at a downstream side of the secondary transfer roller 11.

Figure 6:
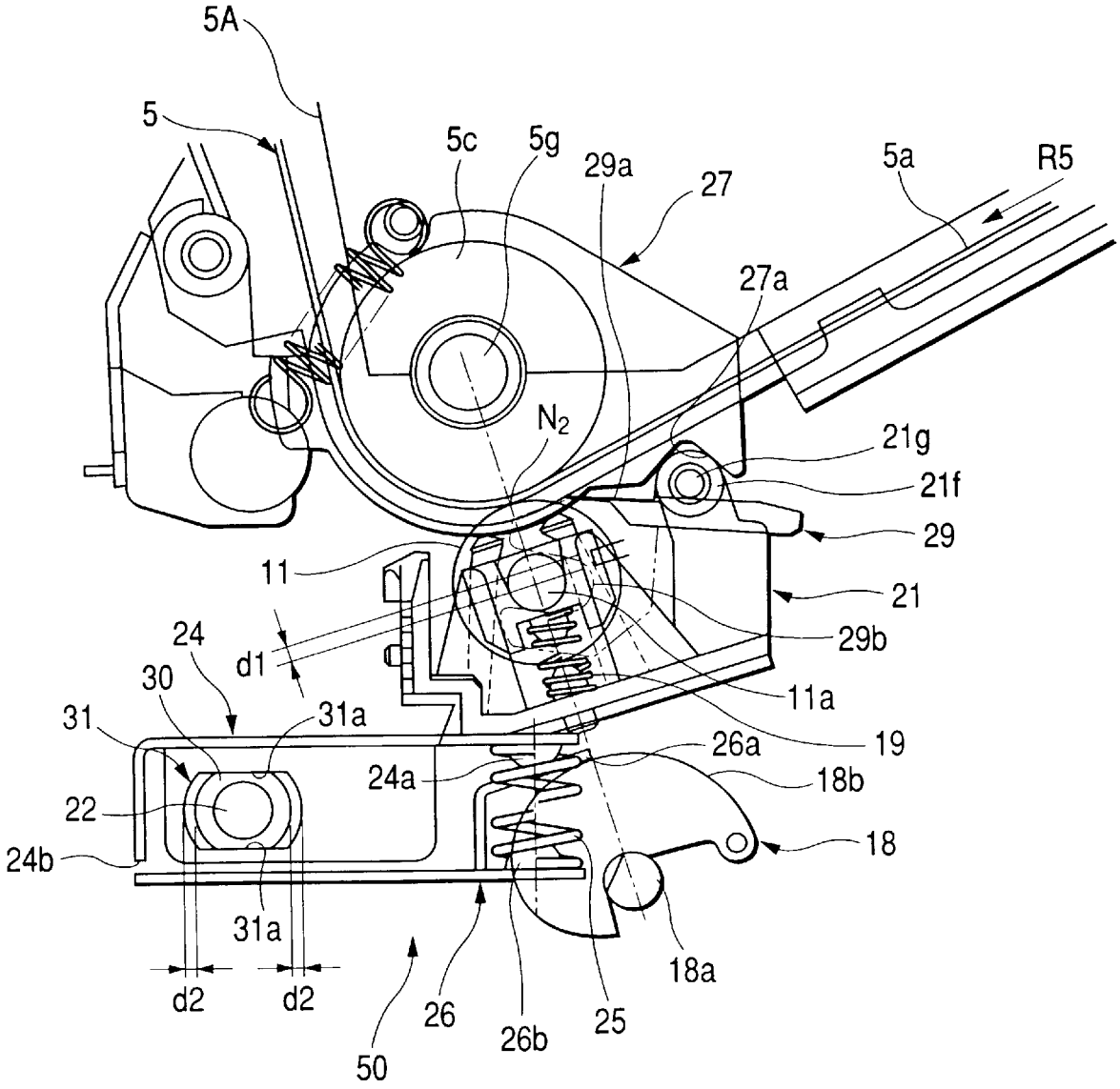
FIG. 6 is an enlarged view of the secondary transfer unit in FIG. 4 at the start of the secondary-transferring.

As shown in FIG. 6, the secondary transfer base plate 24 has an elongated slot 31 having straight left and right edges. A bearing 30 having substantially the same shape as that of the elongated slot 31 and a length (substantially in the conveying direction of the transfer material S) slightly smaller than that of the elongated slot is loosely fitted into the elongated slot 31 with longitudinal play d2 (about 1 mm), and the bearing 30 is rotatably supported by the rock shafts 22 protruded from the apparatus body A in the left-and-right direction. With this arrangement, the secondary transfer base plate 24 can be rocked substantially in the vertical direction with respect to the rock shafts 22 and be shifted along the conveying direction (left-and-right direction) of the transfer material S. That is to say, the rocking center of the secondary transfer unit 50 can be shifted in the conveying direction of the transfer material S. Incidentally, regarding the conveying direction of the transfer material S, both left and right ends (both ends in the direction perpendicular to the plane of FIG. 6) of the secondary transfer base plate 24 can independently be shifted substantially in a horizontal direction, and, in this case, the shiftable distance becomes greater than the play 2*d* about by two times (about 2 mm).

Further, the secondary transfer frame pressurizing members 26 are rockable in coaxial with the rock shafts 22 of the secondary transfer base plate 24. A tip end of each secondary transfer frame pressurizing member 26 remote from the corresponding rock shaft 22 is provided with an upwardly extending boss portion 26*b*, and a secondary transfer frame pressurizing spring (compression spring) 25 is disposed between the boss portion 26*b* and a boss portion 24*a* extending downwardly from the secondary transfer base plate 24. In the vicinity of the boss portion 26*b* of the secondary transfer frame pressurizing member 26, there is disposed a contact portion 26*a* against which a cam surface 18*b* of the eccentric cam 18 rotated around a shaft 18*a* abuts. When the eccentric cam 18 is situated at a position shown in FIG. 5, the secondary transfer frame pressurizing member 26 is located at a lowermost position, and, in this case, the secondary transfer frame pressurizing spring 25 is in a maximum extended condition and a stopper portion 24*b* at a lower end of the secondary transfer base plate 24 abuts against the secondary transfer frame pressurizing member 26 (lowermost position). In this case, in the entire secondary transfer unit 50, the secondary transfer roller 11 is located at the retard position where the roller is spaced apart from the intermediate transfer belt 5*a*. Further, in this case, a portion of the cam surface 18*b* of the eccentric cam 18 abuts against a lower surface of the secondary transfer base plate 24 to regulate a lower limit position of the secondary transfer base plate 24. Configurations and arrangement positions of the eccentric cam 18 and the secondary transfer frame pressurizing member 26 are determined in consideration of the points that a shift distance between the upper limit position and the lower limit position of the secondary transfer roller 11 is maintained, that the secondary transfer unit 50 except the eccentric cam 18 is lifted, that the secondary transfer unit 50 is supported to prevent it from dropping, and that the secondary transfer unit 50 is supported even during the rotation of the eccentric cam 18.

Further, the secondary transfer unit 50 is provided with a secondary transfer inlet guide 29 rocked around the shafts 21*g* coaxial with the coaxial cylindrical abutment portions 21*f* provided on the left and right ends (both ends in the direction perpendicular to the plane of FIG. 6) of the secondary transfer frame 21. The secondary transfer inlet guide 29 has a U-groove shaped slide guide portion (engagement portion) 29*b* (shown by the two dot and chain line) opened toward a downstream side in the conveying direction of the transfer material S, which slide guide portion can slidingly receive the core shaft 11*a* of the secondary transfer roller 11. By the presence of the slide guide portion 29*b*, even if the position of the secondary transfer roller 11 is changed, a distance L1 (FIG. 5) between the peripheral surface of the secondary transfer roller 11 and a guide surface (contacted with the rear surface of the transfer material S) 29*a* of the secondary transfer inlet guide 29 is always kept constant. Further, a tip end of the secondary transfer inlet guide 29, i.e., a most downstream portion of the guide surface 29*a* in the conveying direction of the transfer material S is positioned slightly above the secondary transfer nip $N_2$ toward the intermediate transfer belt 5*a*. With this arrangement, the tip end of the transfer material S supplied to the secondary transfer nip $N_2$ while being guided by the secondary transfer inlet guide 29 abuts against the intermediate transfer belt 5*a* prior to the secondary transfer roller 11, with the result that the transfer material can easily be entered into the secondary transfer nip $N_2$.

In the above-mentioned secondary transfer unit 50, the positioning abutment portions 21*f* and the core shaft 11*a* of the secondary transfer roller 11 are arranged in parallel with each other with high accuracy. That is to say, since the abutment portions 21*f* are directly formed on the secondary transfer frame 21 and the core shaft 11*a* is supported by the bearings 20 guided by the slide guides 21*b* directly formed on the secondary transfer frame 21, the parallelism of the core shaft 11*a* of the secondary transfer roller 11 with respect to the abutment portions 21*f* can be enhanced.

The intermediate transfer unit 5 is provided with V-shaped groove portions (positioning portions) 27*a* for accurately regulating the positions of the abutment portions 21*f* when the secondary transfer unit 50 is located at the transfer position shown in FIG. 6.

Positioning members 27 are attached to lower ends of the left and right (direction perpendicular to the plane of FIG. 6) of the frames 5A of the intermediate transfer unit 5. Each positioning member 27 is provided with a holding portion 27*b* for holding a bearing 5*h* for rotatably supporting a shaft 5*g* of the secondary transfer counter roller 5*c*, and the V-shaped groove portion 27*a* against which the corresponding abutment portion 21*f* abuts. As will be described later, the groove portions 27*a* serve to position the entire secondary transfer unit 50 by abutting two points of the peripheral surface of each abutment portion 21*f* against each groove portion, and the positions and shapes of the groove portions is accurately determined with respect to the holding portions 27*b*.

Next, operations of the intermediate transfer unit 5 and the secondary transfer unit 50 will be explained.

As mentioned above, before the four color (yellow, magenta, cyan and black) toner images are first-transferred to the intermediate transfer belt 5*a*, the secondary transfer unit 50 is located at the retard position shown in FIG. 5. When the eccentric cam 18 is rotated in the direction R18 to secondary-transfer the toner images on the intermediate transfer belt 5*a* onto the transfer material S collectively, the cam surface 18*b* of the eccentric cam 18*b* lifts the contact portion 26*a* of the secondary transfer frame pressurizing member 26, with the result that the secondary transfer base plate 24 is lifted through the secondary transfer frame pressurizing spring 25. In this case, the secondary transfer frame pressurizing member 26 and the secondary transfer base plate 24 are rotated around the rock shafts 22, thereby lifting the secondary transfer frame 21.

The abutment portions 21*f* on both left and right ends of the secondary transfer frame 21 are gradually urged against the groove portions 27*a* of the positioning members 27 of the intermediate transfer unit 5 by the action of the secondary transfer frame pressurizing spring 25, thereby positioning the secondary transfer frame 21 with respect to the intermediate transfer unit 5. In this case, as shown in FIG. 6, since there is the play d2 between the elongated slot 31 of the secondary transfer base plate 24 and the bearing 30, both left and right ends of the entire secondary transfer unit 50 can be shifted independently in the conveying direction of the transfer material S by an amount corresponding to the play. Accordingly, when the eccentric cam 18 is stopped after rotated by a half revolution and the secondary transfer unit 50 is located at the transfer position shown in FIG. 6, the abutment portions 21*f* are urged against the groove portions 27*a* by the secondary transfer frame pressurizing spring 25, thereby positioning the secondary transfer unit with high accuracy. As mentioned above, the groove portions 27*a* are formed accurately with respect to the holding portions 27*b* of the secondary transfer counter roller 5*c*, and the core shaft 11*a* of the secondary transfer roller 11 is positioned accurately with respect to the abutment portions 21*f*. Accordingly, as mentioned above, by accurately positioning the abutment portions 21*f* with respect to the groove portions 27*a*, the core shaft 11*a* of the secondary transfer roller 11 can accurately be positioned in parallel with the shaft 5*g* of the secondary transfer counter roller 5*c*, and, thus, the secondary transfer roller 11 can accurately be positioned in parallel with the secondary transfer counter roller 5*c*.

In this case, as shown in FIG. 6, the secondary transfer roller 11 is urged and shifted by an amount of d1. Accordingly, since the spring force of the secondary transfer roller pressurizing spring 19 is set to be sufficiently smaller than the spring force of the secondary transfer frame pressurizing spring 25, the secondary transfer roller 11 is urged against the intermediate transfer belt 5*a* only by the spring force of the secondary transfer roller pressurizing spring 19.

Further, since the secondary transfer inlet guide 29 is rocked around the shafts 21*g* coaxial with the abutment portions 21*f* of the secondary transfer frame 21 and the U-groove shaped slide guide portion 29*b* is fitted onto the core shaft 11*a* of the secondary transfer roller 11, the distance Li between the outer peripheral surface of the secondary transfer roller 11 and the guide surface 29*a* of the secondary transfer inlet guide 29 is always kept constant. Further, as mentioned above, since the secondary transfer inlet guide 29 can be rocked around the groove portions 27*a* of the intermediate transfer unit 5, the secondary transfer inlet guide can accurately be positioned with respect to the intermediate transfer unit 5.

<Second Embodiment>

In the first embodiment, the color image forming apparatus in which the intermediate transfer belt is used as the intermediate transfer member was explained.

Figure 7:
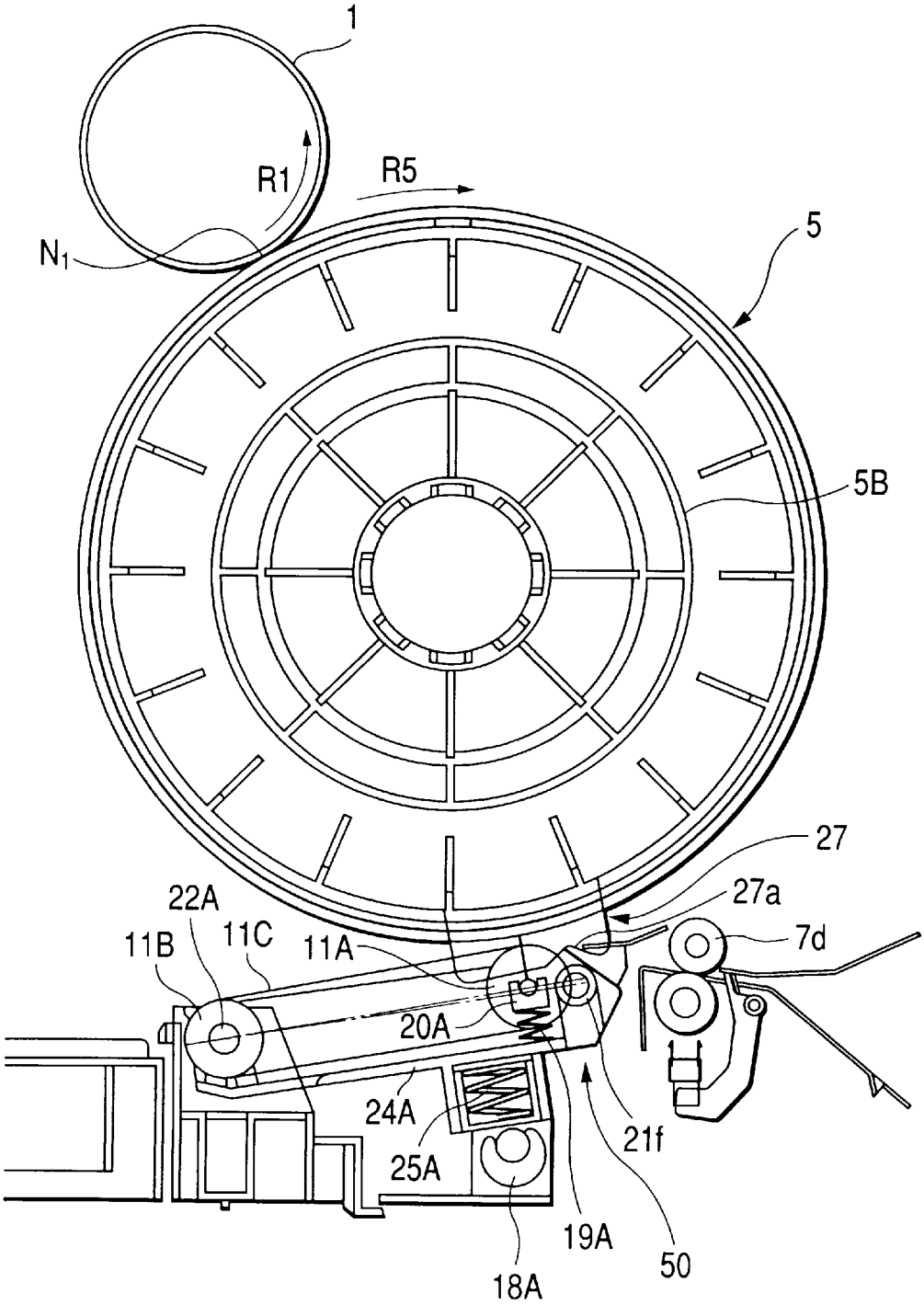
FIG. 7 is a view showing an intermediate transfer unit and a secondary transfer unit of an image forming apparatus according to a second embodiment of the present invention during first-transferring.
Figure 8:
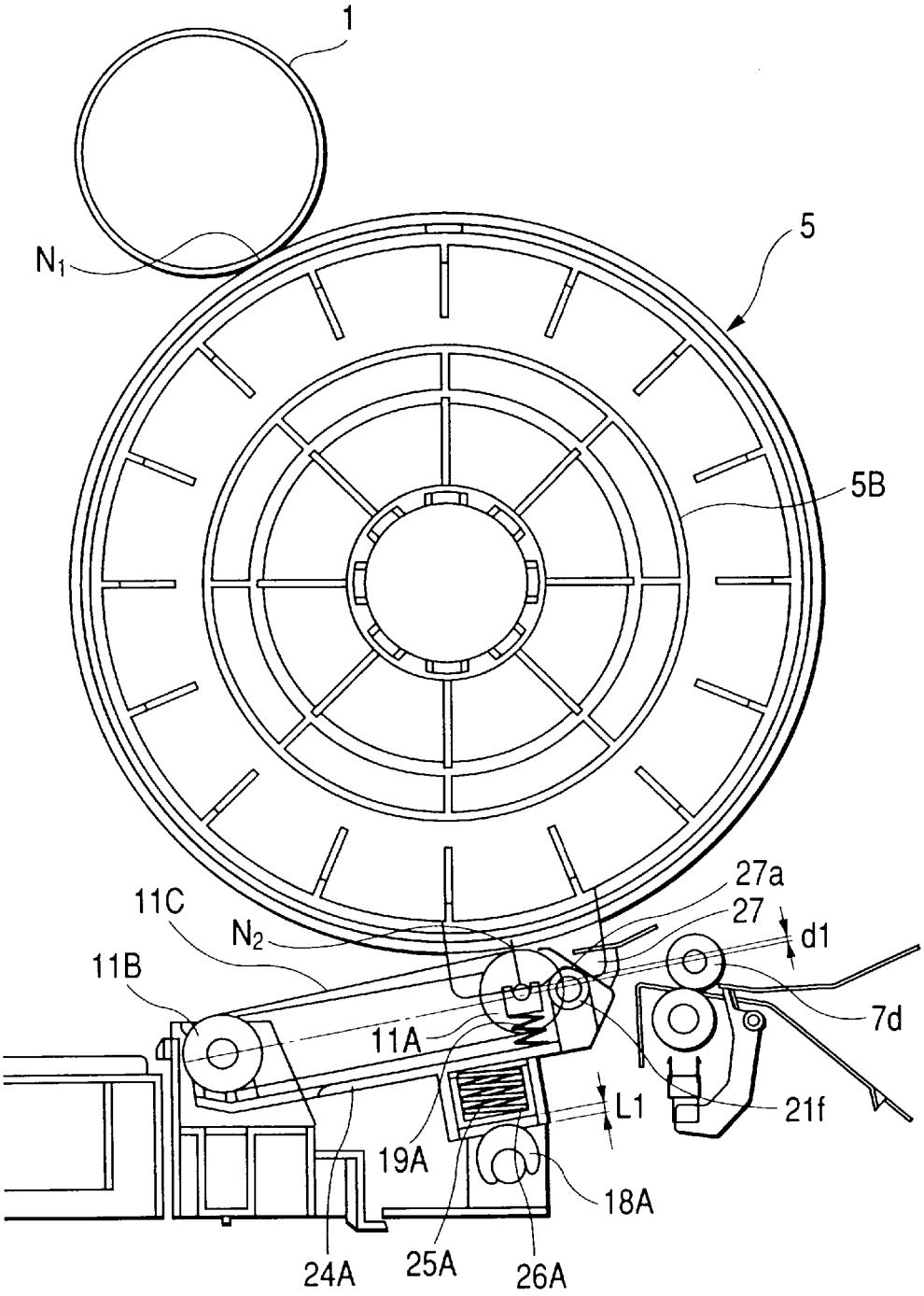
FIG. 8 is a view showing the intermediate transfer unit and the secondary transfer unit of the image forming apparatus according to the second embodiment during secondary-transferring.

To the contrary, in a second embodiment of the present invention, a color image forming apparatus in which an intermediate transfer drum 5B having a conductive layer (as an electrode) to which voltage is applied and a resin layer to which the toner images are transferred is used as an intermediate transfer member will be explained with reference to FIGS. 7 and 8. Incidentally, in the case where the intermediate transfer drum 5B is used as the intermediate transfer member, when the transfer material S is separated from the intermediate transfer drum 5B after the secondary-transferring, since the poor separation can easily occur in comparison with the separation of the transfer material from the intermediate transfer belt by utilizing the curvature of the belt, in order to prevent such poor separation, in place of the secondary transfer roller, a secondary transfer belt 11C is used to effect electrostatic separation. FIG. 7 shows a condition that the secondary transfer belt 11C is spaced apart from the photosensitive drum 1, and FIG. 8 shows a condition that the secondary transfer belt 11C is contacted with the photosensitive drum 1. Incidentally, a driven roller 11A has the same function as the secondary transfer roller in the first embodiment.

As shown in FIG. 7, the image forming apparatus according to the second embodiment includes the photosensitive drum 1 rotated in the direction R1, an intermediate transfer unit 5 having the intermediate transfer drum 5B, and a secondary transfer unit 50 having the secondary transfer belt 11C.

The intermediate transfer drum 56 is constituted by a cylindrical drum base coated by an elastic member and is rotatably supported by intermediate transfer frames (not shown) at its both ends. Each intermediate transfer frame is provided with a positioning member 27 protruded downwardly below the outer peripheral surface of the photosensitive drum 1, which positioning member 27 has a V-shaped groove portion (positioning portion) 27*a* formed therein.

The secondary transfer unit 50 has the secondary transfer frame 24A provided at its tip end with abutment portions 21*f* which can be engaged by and disengaged from the positioning portions 27*a*. The secondary transfer frame 24A rotatably supports the driven roller 11A via a roller pressurizing spring 19A (attached to the upper surface of the frame) and bearings 20A and also rotatably supports the drive roller 11B via rock shafts 22A, and the endless secondary transfer belt 11C are mounted and wound around the drive roller 11B and the driven roller 1A. The secondary transfer frame 24A is rotatably supported by the rock shafts 22. A secondary transfer frame pressurizing spring 25A is disposed between a lower surface of the secondary transfer frame 24A and a secondary transfer pressurizing member 26A. An eccentric cam 18A for shifting the secondary transfer pressurizing member 26A in a vertical direction is contacted with a lower surface of the secondary transfer pressurizing member 26A.

In the color image forming apparatus having the above-mentioned construction, before the four color images successively formed on the photosensitive drum 1 are successively transferred onto the intermediate transfer drum 5B in a superimposed fashion at the first transfer nip $N_1$ by applying predetermined voltage to the conductive layer from a power source (not shown), as shown in FIG. 7, the secondary transfer belt 11C is spaced apart from the surface of the intermediate transfer drum 5B. When the eccentric cam 18A is rotated as shown in FIG. 8, the secondary transfer pressurizing member 26A is lifted to rock and lift the tip end of the secondary transfer frame 24A around the rock shafts 22A (at base end side) via the secondary transfer frame pressurizing spring 25A, with the result that the abutment portions 21*f* are urged against the V-shaped groove portions 27*a* of the intermediate transfer drum 5B. Consequently, the driven roller 11A is accurately positioned with respect to the intermediate transfer drum 5B. In this case, the roller pressurizing spring 19A is compressed by an amount of d1, with the result that the driven roller 11A is urged against the intermediate transfer drum 5B by the force of the compressed spring to form the good secondary transfer nip $N_2$. The toner images on the intermediate transfer drum 5B are collectively transferred onto the transfer material S supplied to the secondary transfer nip $N_2$ at a predetermined timing.

Incidentally, also in the second embodiment, similar to the rock shafts 22 of the first embodiment, in the arrangement including the rock shafts 22A, since the left and right ends of the secondary transfer frame 24A can independently be shifted substantially in a horizontal direction (conveying direction of the transfer material S), the positioning accuracy of the driven roller 11A with respect to the intermediate transfer drum 5B can be enhanced.

<Third Embodiment>

The present invention is not limited to the color image forming apparatuses explained in connection with the first and second embodiments, but, for example, can be applied to a mono-color image forming apparatus for forming a mono-color image by using black toner. Of course, a mono-color image may be formed by using a single color other than black. That is to say, in place of the intermediate transfer belt 5*a* shown in FIG. 5, a photosensitive belt is used, and a black toner image is formed on the unitized photosensitive belt by the developing device, and, by applying predetermined voltage to a transfer roller (in place of the secondary transfer roller 11), the toner image is transferred onto the transfer material. Substantially without changing the characteristic portions of the present invention, the positioning accuracy of the transfer roller (corresponding to the secondary transfer roller 11 in FIG. 5 and is similarly unitized) with respect to the photosensitive belt can be enhanced and the transfer nip can be stabilized.

Further, in place of the intermediate transfer drum 5B in FIG. 7, a photosensitive drum is used, and a black toner image is formed on the unitized photosensitive belt by the developing device, and the toner image may be transferred onto the transfer material. Also in this case, substantially without changing the characteristic portions of the present invention, the positioning accuracy of the transfer roller (corresponding to the driven roller 11A in FIG. 7) with respect to the photosensitive drum can be enhanced. Further, the photosensitive belt and the photosensitive drum can detachably mounted on the apparatus body A, as is in the mounting/dismounting mechanisms for the intermediate transfer unit 5 and the cartridge B explained in connection with the first embodiment.

As mentioned above, since the secondary transfer member (transfer roller) is positioned with respect to the intermediate transfer member (photosensitive member) by abutting the abutment portions of the secondary transfer frame against the positioning portions of the intermediate transfer frame, 1. the urging force of the secondary transfer member (transfer roller) with respect to the intermediate transfer member (photosensitive member) can be stabilized and kept constant, and the secondary transfer nip (transfer nip) can be stabilized.

Further, since the left and right ends of the secondary transfer frame can be independently shifted in the conveying direction of the transfer material, 2. the positioning accuracy of the secondary transfer member (transfer roller) with respect to the intermediate transfer member (photosensitive member) can be enhanced;
3. the parallelism between the secondary transfer counter roller and the secondary transfer member (transfer roller) can be improved through the intermediate transfer member (photosensitive member); and
4. even if there is unevenness in the attachment positions of the intermediate transfer frame and the secondary transfer frame with respect to the apparatus body, the positional relation between the intermediate transfer member (photosensitive member) and the secondary transfer member (transfer roller) can always be stabilized and kept constant.

Further, since the secondary transfer inlet guide (transfer inlet guide) is pivotally supported by the same shafts as the abutment portions and the core shaft of the secondary transfer member (transfer roller) follows the engagement portions, 5. the position of the secondary transfer inlet guide (transfer inlet guide) with respect to the secondary transfer member (transfer roller) can always be kept constant;
6. the positioning accuracy of the secondary transfer inlet guide (transfer inlet guide) with respect to the intermediate transfer member (photosensitive member) and the secondary transfer member (transfer roller) can be effectively maintained; and
7. the penetration of the transfer material into the secondary transfer nip (transfer nip) between the intermediate transfer member (photosensitive member) and the secondary transfer member (transfer roller) can be stabilized.

In this way, the poor image and the skew-feed of the transfer material due to unevenness and fluctuation of the urging force of the secondary transfer member (transfer roller) with respect to the intermediate transfer member (photosensitive member) can be prevented to improve the image quality, and the penetration of the transfer material into the secondary transfer nip (transfer nip) is stabilized to prevent the poor image tip and the sheet jam.

<Fourth Embodiment>

A mechanism for transmitting a rotational driving force to the secondary transfer roller (drive roller 11B in the second embodiment, and, transfer roller in the third embodiment) in the image forming apparatuses according to the first to third embodiments will be explained.

Figure 9:
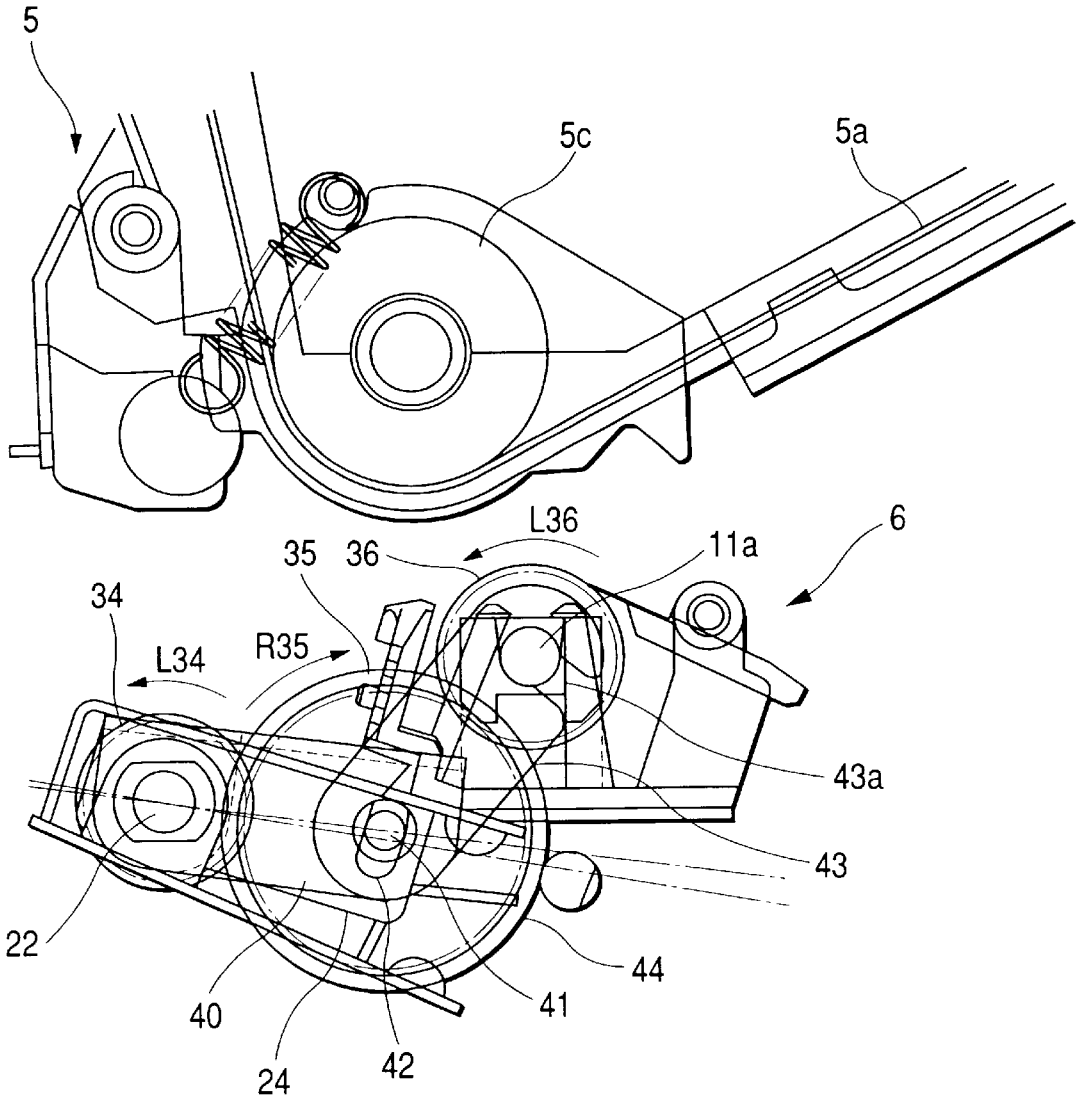
FIG. 9 is a view showing an intermediate transfer unit and a secondary transfer unit of an image forming apparatus according to an embodiment of the present invention before secondary-transferring.
Figure 10:
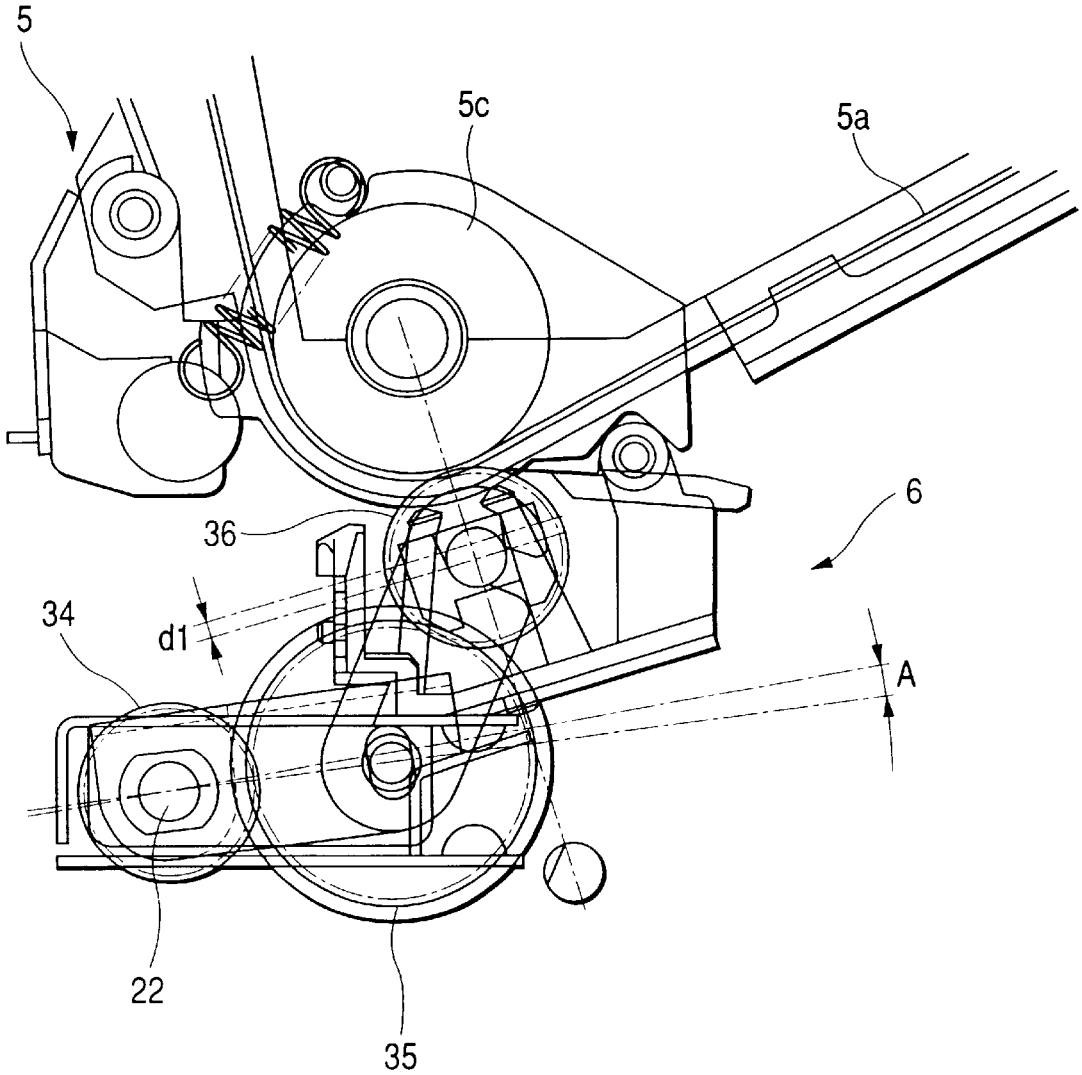
FIG. 10 is a view showing the intermediate transfer unit and the secondary transfer unit of the image forming apparatus according to the embodiment of the present invention at the start of the secondary-transferring.

FIGS. 9 and 10 are schematic views showing a driving force transmitting means for driving the secondary transfer roller, before the secondary-transferring and at the start of the secondary-transferring, respectively.

In FIGS. 9 and 10, a drive gear 34 provided on one end of one of the rock shafts 22 receives a rotational force from the driven gear (not shown) provided on one end of the other rock shaft and is rotated in a direction shown by the arrow L34. A first link 40 is provided on the rock shaft 22 for rocking movement around the rock shaft, and an idler gear 35 is provided on the first link 40 via an idler gear shaft 41 to be engaged by the drive gear 34.

A tip end of the idler gear shaft 41 is inserted into an elongated hole 42 formed in the secondary transfer base plate 24, so that the idler gear 35 can be rocked within the elongated hole 42 with keeping a pitch distance between the idler gear and the drive gear 34 constant.

Further, a second link 43 is provided on the idler gear shaft 41 of the first link 40 for pivotal movement around the shaft, and the metallic core shaft 11*a* of the secondary transfer roller 11 is fitted into a snap-fit portion 43*a* at a tip end of the second link. The metallic core shaft 11*a* is provided with a driven gear 36 (for the secondary transfer roller) which is meshed with the idler gear 35. The idler gear 35 is rotated in a direction shown by the arrow L35 and the driven gear 36 is rotated in a direction shown by the arrow L36.

When the condition before the secondary-transferring shown in FIG. 6 is changed to the condition at the start of the secondary-transferring shown in FIG. 7, due to the urging force of the secondary transfer roller 11 against the intermediate transfer belt 5*a*, the secondary transfer roller 11 and the driven gear 36 provided on the metallic core shaft 11*a* are urged against the intermediate transfer belt 5*a* and the secondary transfer counter roller 5*c* and are lifted by the distance d1.

In synchronous with this, the idler gear 35 is shifted around the rock shaft 22 by an angle A. However, since the gear pitch distance is always kept constant by the action of the second link 43, the stable rotational force is transmitted to the secondary transfer roller 11.

Further, since the snap-fit structure is provided on the tip end 43*a* of the second link, the secondary transfer roller can easily be exchanged.

By using helical gears as the drive gear 34, idler gear 35 and driven gear 36, a force for urging the secondary transfer roller 11 toward one side is generated to stabilize the axial position of the secondary transfer roller 11.

By providing a flange portion 44 on the idler gear 35, the secondary transfer roller 11 can be prevented from detaching in the axial direction.

As mentioned above, since the secondary transfer roller (transfer roller) can accurately be positioned with respect to the intermediate transfer member (photosensitive member) to urge the intermediate transfer member with the predetermined urging force stably, the poor transferring and skew-feed of the transfer material can be prevented to provide the good image.

What is claimed is:

1. An image forming apparatus comprising:

a first unit having an image bearing member for bearing an image;

a second unit having a transfer means for transferring the image on said image bearing member onto a transfer material, said second unit being rockable around a rock center to engage with and disengage from said first unit and having a positioning portion to be positioned at a predetermined position of said first unit; and shift means for permitting a shifting movement of the rock center so that said positioning portion on said second unit is positioned at the predetermined position on said first unit even when a relative position of said first unit with respect to a main body of the image forming apparatus in a conveying direction of the transfer material is changed.

2. An image forming apparatus according to claim 1, wherein, said positioning portion of said second unit is disposed upstream of an image transferring position of said transfer means in the conveying direction of the transfer material.

3. An image forming apparatus according to claim 2, wherein said second unit has a guide member in the vicinity of said positioning portion thereof to guide the transfer material to the image transferring position.

4. An image forming apparatus according to claim 3, wherein, when the positioning portion of said second unit is positioned at the predetermined position of said first unit, said guide member is shifted with respect to said first unit.

5. An image forming apparatus according to claim 1, wherein said positioning portion is provided on each of plural portions of said second unit.

6. An image forming apparatus according to claim 1, wherein said second unit has a support hole for supporting a rock shaft provided on said main body, and a length of said support hole is greater than a length of said rock shaft in a shifting direction of the rock center.

7. An image forming apparatus according to claim 1, wherein said second unit has a pressurizing means for pressurizing said transfer means against said image bearing member.

8. An image forming apparatus according to claim 7, wherein said pressurizing means has a first pressurizing member, and a second pressurizing member having a pressurizing force smaller than that of said first pressurizing member.

9. An image forming apparatus according to claim 1, wherein said transfer means comprises a roller which can be engaged with and disengaged from said image bearing member.

10. An image forming apparatus according to claim 1, wherein said first unit is detachable with respect to said main body.

11. An image forming apparatus comprising:

an image bearing member for bearing an image;

a first unit having an intermediate transfer member to which the image on said image bearing member is transferred;

a second unit having a transfer means for transferring the image on said intermediate transfer member onto a transfer material, said second unit being rockable around a rock center to engage with and disengage from said first unit and having a positioning portion to be positioned at a predetermined position on said first unit; and shift means for permitting a shifting movement of said rock center so that said positioning portion on said second unit is positioned at the predetermined position of said first unit even when a relative position of said first unit with respect to a main body of the image forming apparatus in a conveying direction of the transfer material is changed.

12. An image forming apparatus according to claim 11, wherein said positioning portion of said second unit is disposed upstream of an image transferring position of said transfer means in the conveying direction of the transfer material.

13. An image forming apparatus according to claim 12, wherein said second unit has a guide member in the vicinity of said positioning portion thereof to guide the transfer material to said image transferring position.

14. An image forming apparatus according to claim 13, wherein, when said positioning portion of said second unit is positioned at said predetermined position of said first unit, said guide member is shifted with respect to said first unit.

15. An image forming apparatus according to claim 11, wherein said positioning portion of said second unit is provided at each of both ends of said second unit in an axial direction of a rock shaft.

16. An image forming apparatus according to claim 11, wherein said positioning portion is provided on each of plural portions of said second unit.

17. An image forming apparatus according to claim 11, wherein said second unit has a support hole for supporting a rock shaft provided on said main body, and a length of said support hole is greater than a length of said rock shaft in a shifting direction of said rock center.

18. An image forming apparatus according to claim 11, wherein said second unit has a pressurizing means for pressurizing said transfer means against said image bearing member.

19. An image forming apparatus according to claim 18, wherein said pressurizing means has a first pressurizing member, and a second pressurizing member having a pressurizing force smaller than that of said first pressurizing member.

20. An image forming apparatus according to claim 11, wherein said transfer means has a roller which can be engaged with and disengaged from said image bearing member.

21. An image forming apparatus according to claim 11, wherein said first unit is detachable with respect to said main body.

22. An image forming apparatus according to claim 11, wherein said second unit is detachable with respect to said main body.

23. An image forming apparatus according to claim 11, further comprising a third unit having said image bearing member which said third unit is detachable with respect to said main body.

24. An image forming apparatus according to claim 11, wherein said intermediate transfer member can be engaged with and disengaged from said image bearing member.

25. An image forming apparatus according to any one of claims 11–24, further comprising:

transfer means for transferring repeatedly toner images from said image bearing member to said intermediate transfer member to form a plural color toner image on said intermediate transfer member and transferring said plural color toner image formed on said intermediate transfer member onto the transfer material.

* * * * *

UNITED STATES PATENT AND TRADEMARK OFFICE

CERTIFICATE OF CORRECTION

PATENT NO. : 5,983,062

DATED : November 9, 1999

INVENTOR(S): TAKAO SAMESHIMA

It is certified that error appears in the above-identified patent and that said Letters Patent is hereby corrected as shown below:

COLUMN 3:
Line 3, "can" should read --can be--.

COLUMN 4:
Line 45, "uniforming" should read --uniformly--.

COLUMN 5:
Line 12, "is" should read --are--.

COLUMN 8:
Line 38, "was" should read --are--.

COLUMN 9:
Line 57, "were" should read --are--.

COLUMN 10:
Line 46, "an" should read --a--.

COLUMN 13:
Line 19, "rotated" should read --being rotated--.

COLUMN 14:
Line 37, "22A, and" should read --22A. This and--.

UNITED STATES PATENT AND TRADEMARK OFFICE

CERTIFICATE OF CORRECTION

PATENT NO. : 5,983,062

DATED : November 9, 1999

INVENTOR(S): TAKAO SAMESHIMA

It is certified that error appears in the above-identified patent and that said Letters Patent is hereby corrected as shown below:

COLUMN 15:
Line 40, "can" should read --can be--.

COLUMN 16:
Line 56, "with" should read --while--.

Signed and Sealed this

Thirty-first Day of October, 2000

*Attest:*

Q. TODD DICKINSON

*Attesting Officer*

*Director of Patents and Trademarks*